US010292560B2

(12) United States Patent
Doughty

(10) Patent No.: US 10,292,560 B2
(45) Date of Patent: May 21, 2019

(54) ROLLER BRUSH FOR SURFACE CLEANING ROBOTS

(71) Applicant: iRobot Corporation, Bedford, MA (US)

(72) Inventor: Brian Doughty, Framingham, MA (US)

(73) Assignee: iRobot Corporation, Bedford, MA (US)

( * ) Notice: Subject to any disclaimer, the term of this patent is extended or adjusted under 35 U.S.C. 154(b) by 489 days.

(21) Appl. No.: 15/088,802

(22) Filed: Apr. 1, 2016

(65) Prior Publication Data

US 2016/0213217 A1 Jul. 28, 2016

Related U.S. Application Data

(63) Continuation of application No. 13/835,501, filed on Mar. 15, 2013, now Pat. No. 9,326,654.

(51) Int. Cl.
*A47L 9/04* (2006.01)
*A47L 11/24* (2006.01)
(Continued)

(52) U.S. Cl.
CPC ..... *A47L 11/282* (2013.01); *A47L 9/009* (2013.01); *A47L 9/04* (2013.01); *A47L 9/0477* (2013.01);
(Continued)

(58) Field of Classification Search
CPC . A47L 9/04; A47L 9/009; A47L 11/24; A47L 11/282; A47L 11/32; A47L 11/4072
See application file for complete search history.

(56) References Cited

U.S. PATENT DOCUMENTS 1,829,548 A 10/1931 Smellie et al.
2,578,549 A 12/1951 Hooban
(Continued)

FOREIGN PATENT DOCUMENTS

EP 1428468 A1 6/2004
JP 05049566 A 3/1993
(Continued)

OTHER PUBLICATIONS

International Search Report for related Application No. PCT/US2014/025865 dated Jul. 7, 2014.
(Continued)

*Primary Examiner* — Randall E Chin
(74) *Attorney, Agent, or Firm* — Myers Bigel, P.A.

(57) ABSTRACT

A mobile surface cleaning robot that includes a robot body having a forward drive direction and a drive system supporting the robot body above a floor surface. The drive system includes right and left drive wheels and a caster wheel assembly disposed rearward of the drive wheels. The caster wheel assembly includes a caster wheel supported for vertical movement and a suspension spring biasing the caster wheel toward the floor surface. The robot also includes a cleaning system supported by the robot body forward of the drive wheels and having at least one cleaning element that engages the floor surface. The suspension spring has a spring constant sufficient to elevate a rear end of the robot body above the floor surface to maintain engagement of the at least one cleaning element with the floor surface.

20 Claims, 16 Drawing Sheets

(51) Int. Cl.

| | |
|---|---|
| ***A47L 11/32*** | (2006.01) |
| ***A47L 11/33*** | (2006.01) |
| ***A47L 11/282*** | (2006.01) |
| ***A47L 9/00*** | (2006.01) |
| ***A47L 11/40*** | (2006.01) |

(52) U.S. Cl.

CPC ..... *A47L 11/24* (2013.01); *A47L 11/32* (2013.01); *A47L 11/33* (2013.01); *A47L 11/4041* (2013.01); *A47L 11/4072* (2013.01); *A47L 2201/00* (2013.01); *A47L 2201/06* (2013.01)

(56) References Cited

U.S. PATENT DOCUMENTS

| | | | | |
|---|---|---|---|---|
| 4,357,727 | A | 11/1982 | McDowell | |
| 5,341,540 | A | 8/1994 | Soupert et al. | |
| 5,452,490 | A | 9/1995 | Brundula et al. | |
| 5,537,711 | A | 7/1996 | Tseng | |
| 5,787,545 | A | 8/1998 | Colens | |
| 5,991,951 | A * | 11/1999 | Kubo | A47L 11/16 15/340.4 |
| 6,212,732 | B1 | 4/2001 | Tajima et al. | |
| 6,389,329 | B1 | 5/2002 | Colens | |
| 6,532,404 | B2 | 3/2003 | Colens | |
| 6,553,612 | B1 | 4/2003 | Dyson et al. | |
| 6,594,844 | B2 | 7/2003 | Jones | |
| 6,605,156 | B1 | 8/2003 | Clark et al. | |
| 6,625,843 | B2 | 9/2003 | Kim et al. | |
| 6,690,134 | B1 | 2/2004 | Jones et al. | |
| 6,742,220 | B2 | 6/2004 | Nagai et al. | |
| 6,781,338 | B2 | 8/2004 | Jones et al. | |
| 6,809,490 | B2 | 10/2004 | Jones et al. | |
| 6,841,963 | B2 | 1/2005 | Song et al. | |
| 6,883,201 | B2 | 4/2005 | Jones et al. | |
| 6,965,209 | B2 | 11/2005 | Jones et al. | |
| 6,999,850 | B2 | 2/2006 | McDonald | |
| 7,155,308 | B2 | 12/2006 | Jones | |
| 7,159,276 | B2 | 1/2007 | Omoto et al. | |
| 7,171,723 | B2 | 2/2007 | Kobayashi et al. | |
| 7,173,391 | B2 | 2/2007 | Jones et al. | |
| 7,196,487 | B2 | 3/2007 | Jones et al. | |
| 7,248,951 | B2 | 7/2007 | Hulden | |
| 7,360,277 | B2 | 4/2008 | Moshenrose et al. | |
| 7,389,166 | B2 | 6/2008 | Harwig et al. | |
| 7,441,298 | B2 | 10/2008 | Svendsen et al. | |
| 7,444,206 | B2 | 10/2008 | Abramson et al. | |
| 7,448,113 | B2 | 11/2008 | Jones et al. | |
| 7,474,941 | B2 | 1/2009 | Kim et al. | |
| 7,503,096 | B2 | 3/2009 | Lin | |
| 7,555,363 | B2 | 6/2009 | Augenbraun et al. | |
| 7,571,511 | B2 | 8/2009 | Jones et al. | |
| 7,578,020 | B2 | 8/2009 | Jaworski et al. | |
| 7,603,744 | B2 | 10/2009 | Reindle | |
| 7,617,557 | B2 | 11/2009 | Reindle | |
| 7,620,476 | B2 | 11/2009 | Morse et al. | |
| 7,636,982 | B2 | 12/2009 | Jones et al. | |
| 7,784,139 | B2 | 8/2010 | Sawalski et al. | |
| 7,849,555 | B2 | 12/2010 | Hahm et al. | |
| 7,953,526 | B2 | 5/2011 | Durkos et al. | |
| D647,265 | S | 10/2011 | Follows et al. | |
| 8,316,503 | B2 | 11/2012 | Follows et al. | |
| 8,392,021 | B2 | 3/2013 | Konandreas et al. | |
| 2002/0016649 | A1 | 2/2002 | Jones | |
| 2002/0120364 | A1 | 8/2002 | Colens | |
| 2002/0189871 | A1 | 12/2002 | Won | |
| 2003/0025472 | A1 | 2/2003 | Jones et al. | |
| 2003/0120389 | A1 | 6/2003 | Abramson et al. | |
| 2004/0020000 | A1 | 2/2004 | Jones | |
| 2004/0049877 | A1 | 3/2004 | Jones et al. | |
| 2004/0074038 | A1 | 4/2004 | Im et al. | |
| 2004/0187249 | A1 | 9/2004 | Jones et al. | |
| 2005/0010331 | A1 | 1/2005 | Taylor et al. | |
| 2005/0015914 | A1 | 1/2005 | You et al. | |
| 2005/0021181 | A1 | 1/2005 | Kim et al. | |
| 2005/0076466 | A1 | 4/2005 | Yan | |
| 2005/0204717 | A1 | 9/2005 | Colens | |
| 2005/0217042 | A1 | 10/2005 | Reindle | |
| 2005/0229340 | A1 | 10/2005 | Sawalski et al. | |
| 2005/0246857 | A1 | 11/2005 | Omoto et al. | |
| 2006/0020369 | A1 | 1/2006 | Taylor et al. | |
| 2006/0064828 | A1 | 3/2006 | Stein et al. | |
| 2006/0196003 | A1 | 9/2006 | Song et al. | |
| 2007/0006404 | A1 | 1/2007 | Cheng et al. | |
| 2007/0136981 | A1 | 6/2007 | Dilger et al. | |
| 2007/0244610 | A1 | 10/2007 | Ozick et al. | |
| 2007/0266508 | A1 | 11/2007 | Jones et al. | |
| 2008/0052846 | A1 | 3/2008 | Kapoor et al. | |
| 2008/0058987 | A1 | 3/2008 | Ozick et al. | |
| 2008/0091304 | A1 | 4/2008 | Ozick et al. | |
| 2008/0276408 | A1 * | 11/2008 | Gilbert, Jr. | A47L 11/34 15/320 |
| 2008/0282494 | A1 | 11/2008 | Won et al. | |
| 2008/0307590 | A1 | 12/2008 | Jones et al. | |
| 2010/0049365 | A1 | 2/2010 | Jones et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2010/0287717 | A1 | 11/2010 | Jang et al. | |
| 2010/0306956 | A1 | 12/2010 | Follows et al. | |
| 2010/0313910 | A1 | 12/2010 | Lee et al. | |
| 2012/0090126 | A1 | 4/2012 | Kim et al. | |

FOREIGN PATENT DOCUMENTS

| | | | |
|---|---|---|---|
| JP | 05146382 | A | 6/1993 |
| JP | 06007271 | A | 1/1994 |
| JP | 06014853 | A | 1/1994 |
| JP | H06-59578 | U | 8/1994 |
| JP | 08173355 | A | 7/1996 |
| JP | H09-263140 | A | 10/1997 |
| JP | 2000354567 | A | 12/2000 |
| JP | 2002112931 | A | 4/2002 |
| JP | 2003000484 | A | 1/2003 |
| JP | 2007185228 | A | 7/2007 |
| JP | 2008000382 | A | 1/2008 |
| JP | 2011016011 | A | 1/2011 |
| JP | 2011115541 | A | 6/2011 |
| JP | 2011188951 | A | 9/2011 |
| JP | 2012-096042 | A | 5/2012 |
| JP | 2013-045463 | A | 3/2013 |
| KR | 20000002306 | A | 1/2000 |
| KR | 20090038965 | A | 4/2009 |
| KR | 20130021212 | A | 3/2013 |
| WO | WO-2007065033 | A2 | 6/2007 |
| WO | WO-2009117383 | A2 | 9/2009 |
| WO | WO-2011121816 | A1 | 10/2011 |

OTHER PUBLICATIONS

Japanese Office Action Corresponding to Japanese Patent Application No. 2015-511820; dated Aug. 22, 2016; Foreign Text, 4 Pages, English Translation Thereof, 4 Pages.

* cited by examiner

ROLLER BRUSH FOR SURFACE CLEANING ROBOTS

CROSS REFERENCE TO RELATED APPLICATIONS

This U.S. patent application is a continuation of, and claims priority under 35 U.S.C. § 120 from, U.S. patent application Ser. No. 13/835,501, filed on Mar. 15, 2013, now U.S. Pat. No. 9,326,654, which is hereby incorporated by reference in its entirety.

TECHNICAL FIELD

This disclosure relates to roller brushes for surface cleaning robots.

BACKGROUND

A vacuum cleaner generally uses an air pump to create a partial vacuum for lifting dust and dirt, usually from floors, and optionally from other surfaces as well. The vacuum cleaner typically collects dirt either in a dust bag or a cyclone for later disposal. Vacuum cleaners, which are used in homes as well as in industry, exist in a variety of sizes and models, such as small battery-operated hand-held devices, domestic central vacuum cleaners, huge stationary industrial appliances that can handle several hundred liters of dust before being emptied, and self-propelled vacuum trucks for recovery of large spills or removal of contaminated soil.

Autonomous robotic vacuum cleaners generally navigate, under normal operating conditions, a living space and common obstacles while vacuuming the floor. Autonomous robotic vacuum cleaners generally include sensors that allow it to avoid obstacles, such as walls, furniture, or stairs. The robotic vacuum cleaner may alter its drive direction (e.g., turn or back-up) when it bumps into an obstacle. The robotic vacuum cleaner may also alter drive direction or driving pattern upon detecting exceptionally dirty spots on the floor. Hair and other debris can become wrapped around the brushes and stalling the brushes from their rotation, therefore, making the robot less efficient in its cleaning.

SUMMARY

One aspect of the disclosure provides a rotatable roller brush for a cleaning appliance. The roller brush includes a brush core defining a longitudinal axis of rotation and three or more dual rows of bristles disposed on and equidistantly spaced along a circumference the brush core. Each dual row of bristles includes a first bristle row of a first bristle composition and having a first height and a second bristle row of a second bristle composition stiffer than the first bristle composition and having a second height. The second bristle row is circumferentially spaced from the first bristle row by a gap (e.g., measured as a cord distance along the surface of the brush core) less than or equal to 10% of the first height. Also, the first height is less than or equal to 90% of the second height.

Implementations of the disclosure may include one or more of the following features. In some implementations, the first bristle row of each dual bristle row is forward of the second bristle row in a direction of rotation of the roller brush. The roller brush may include elastomeric vanes arranged between and substantially parallel to the bristle rows. Each vane extends from a first end attached to the brush core to a second end unattached from the brush core.

The vanes may have a third height less than the second height of the second bristle row.

In some implementations, the first bristle row and second bristle row each define a chevron shape arranged longitudinally along the brush core. Each of the bristles of the first bristle row may have a first diameter less than a second diameter of each of the bristles of the second bristle row.

Each brush core may define a longitudinally extending T-shaped channel for releasably receiving a brush element. The brush element includes an anchor defining a T-shape complimentary sized for slidable receipt into the T-shaped channel and at least one dual row of bristles or a vane attached to the anchor.

Another aspect of the disclosure provides a rotatable roller brush assembly for a cleaning appliance. The roller brush assembly includes a first roller brush and a second roller brush arranged rotatably opposite the first roller brush. The first roller brush includes a brush core defining a longitudinal axis of rotation and three or more dual rows of bristles disposed on and equidistantly spaced along a circumference the brush core. Each dual row of bristles includes a first bristle row of a first bristle composition and having a first height and a second bristle row of a second bristle composition stiffer than the first bristle composition and having a second height. The second bristle row is circumferentially spaced from the first bristle row by a gap (e.g., measured as a cord distance along the surface of the brush core) less than or equal to 10% of the first height. Also, the first height is less than or equal to 90% of the second height. The second roller brush includes a brush core defining a longitudinal axis of rotation and three or more rows of bristles disposed on and circumferentially spaced about the brush core.

In some implementations, the first bristle row of each dual bristle row is forward of the second bristle row in a direction of rotation of the roller brush. The first roller brush may include elastomeric vanes arranged between and substantially parallel to the bristle rows. Each vane extends from a first end attached to the brush core of the first roller brush to a second end unattached from the brush core of the first roller brush. Moreover, the vanes may have a third height less than the second height of the second bristle row.

Additionally or alternatively, the second brush may include elastomeric vanes arranged between and substantially parallel to the bristle rows. Each vane extends from a first end attached to the brush core of the second roller brush to a second end unattached from the brush core of the second roller brush. The vanes may be shorter than the bristles of the second roller brush.

In some implementations, the rows of bristles of each roller brush each define a chevron shape arranged longitudinally along the corresponding brush core. The first direction of rotation of the first rotatable brush may be a forward rolling direction with respect to a forward drive direction of the rotatable roller brush assembly.

The roller brush assembly may include a brush bar arranged parallel to and engaging a bristle row by an engagement distance, measured radially with respect to the corresponding brush core, of less than or equal to 0.060 inches. The brush bar interferes with rotation of the engaged roller brush to strip fibers from the engaged bristles.

In yet another aspect of the disclosure, a mobile surface cleaning robot includes a robot body having a forward drive direction and a drive system supporting the robot body above a floor surface for maneuvering the robot across the floor surface. The drive system includes right and left drive wheels disposed on corresponding right and left portions of the robot body. The robot includes a caster wheel assembly disposed rearward of the drive wheels and a cleaning system supported by the robot body forward of the drive wheels. The cleaning system includes a rotatably driven roller brush, which includes a brush core defining a longitudinal axis of rotation and three or more dual rows of bristles disposed on and equidistantly spaced along a circumference the brush core. Each dual row of bristles includes a first bristle row of a first bristle composition and having a first height and a second bristle row of a second bristle composition stiffer than the first bristle composition and having a second height. The second bristle row is circumferentially spaced from the first bristle row by a gap (e.g., measured as a cord distance along the surface of the brush core) less than or equal to 10% of the first height. Also, the first height is less than or equal to 90% of the second height.

In some implementations, at least 5% of the second height of the second bristle row engages with the floor surface. In some examples, the first bristle row of each dual bristle row is forward of the second bristle row in a direction of rotation of the roller brush. A center of gravity of the robot may be located forward of the drive wheels, allowing the robot body to pivot forward about the drive wheels. In some examples, the robot body defines a square front profile or a round profile.

The robot may include at least one clearance regulator roller supported by the robot body and disposed forward of the drive wheels and rearward of the roller brush. The at least one clearance regulator provides a minimum clearance height of at least 2 mm between the robot body and the floor surface.

In some implementations, the robot includes a second roller brush arranged rotatably opposite the first roller brush. The second roller brush includes a brush core defining a longitudinal axis of rotation and three or more rows of bristles disposed on and circumferentially spaced about the brush core. The three or more rows of bristles of the second brush may be dual-rows of bristles. Each dual row of bristles includes a first bristle row of a first bristle composition and having a first height and a second bristle row of a second bristle composition stiffer than the first bristle composition and having a second height. The second bristle row is circumferentially spaced from the first bristle row by a gap (e.g., measured as a cord distance along the surface of the brush core) less than or equal to 10% of the first height. Also, the first height is less than or equal to 90% of the second height.

The cleaning system may include a collection volume disposed on the robot body, a plenum arranged over the first and second roller brushes, and a conduit in pneumatic communication with the plenum and the collection volume.

Another aspect of the disclosure provides a mobile surface cleaning robot that includes a robot body, a drive system, a robot controller, and a cleaning system. The robot body has a forward drive direction. The drive system supports the robot body above a floor surface for maneuvering the robot across the floor surface, and is in communication with the robot controller. The cleaning system, supported by the robot body, includes first and second roller brushes rotatably supported by the robot body. The first roller brush includes a brush core defining a longitudinal axis of rotation, and at least two longitudinal rows of bristles circumferentially spaced about the brush core. Each bristle extends away from a first end attached to the brush core to a second end unattached from the brush core. The bristles all have substantially the same length. The robot body rotatably supports the second roller brush rearward of the first roller brush. The second roller brush includes a brush core defining a longitudinal axis of rotation, and at least two longitudinal dual-rows of bristles circumferentially spaced about the brush core, each dual-row having a first row of bristles having a first bristle length and a second row of bristles adjacent and parallel the first bristle row and having a second bristle length different from the first bristle length. The first and second bristle rows of each dual-row of bristles are separated circumferentially along the brush core by a cord distance of less than about ¼ the first length. Moreover, each bristle extends away from a first end attached to the brush core to a second end unattached from the brush core.

In some implementations, the first bristle length is less than 90% of the second bristle length. In some examples, the first bristle row of each dual-row of bristles is forward of the second bristle row in the direction of rotation of the second roller brush. Additionally or alternatively, the first roller brush may include vanes arranged between and substantially parallel to the rows of bristles. Each vane includes an elastomeric material extending from a first end attached to the brush core to a second end unattached from the brush core. The vanes of the first roller brush may be shorter than the bristles. In some examples, the second roller brush includes vanes arranged between and substantially parallel to the dual-rows of bristles. Each vane includes an elastomeric material extending from a first end attached to the brush core to a second end unattached from the brush core. The vanes of the second roller brush may be shorter than the bristles. In some examples, the rows of bristles of each roller brush each define a chevron shape arranged longitudinally along the corresponding brush core.

In some implementations, the robot includes first and second brush motors. The first brush motor is coupled to the first roller brush and drives the first roller brush in a first direction. The second brush motor is coupled to the second roller brush and drives the second roller brush in a second direction opposite the first direction. Additionally or alternatively, the first direction of rotation may be a forward rolling direction with respect to the forward drive direction.

In some implementations, each brush core defines a longitudinally extending T-shaped channel for releasably receiving a brush element. The brush element includes an anchor defining a T-shape and is complimentary sized for slidable receipt into the T-shaped channel. The brush element also includes at least one longitudinal row of bristles or a vane attached to the anchor. The brush element may include a dual-row of bristles attached to the anchor. Additionally or alternatively, the brush core may define multiple equidistantly circumferentially spaced T-shaped channels.

In some implementations, the cleaning system includes a brush bar arranged parallel to and engaging the bristles of one or both of the roller brushes. The brush bar interferes with rotation of the engaged roller brush to strip fibers from the engaged bristles. In some examples, the cleaning system further includes a collection volume disposed on the robot body, a plenum arranged over the first and second roller brushes, and a conduit in pneumatic communication with the plenum and the collection volume.

Another aspect of the disclosure provides a mobile surface cleaning robot including a robot body having a forward drive direction and a drive system supporting the robot body above a floor surface for maneuvering the robot across the floor surface. The drive system includes right and left drive wheels disposed on corresponding right and left portions of the robot body, and a caster wheel assembly disposed rearward of the drive wheels. The caster wheel assembly includes a caster wheel supported for vertical movement and a suspension spring biasing the caster wheel toward the floor surface. The robot includes a robot controller in communication with the drive system and a cleaning system supported by the robot body forward of the drive wheels. The cleaning system includes at least one cleaning element configured to engage the floor surface, where the suspension spring has a spring constant sufficient to elevate a rear end of the robot body above the floor surface to maintain engagement of the at least one cleaning element with the floor surface.

In some examples, the cleaning element includes a roller brush having bristles. The suspension spring elevates the rear end of the robot body above the floor surface, causing engagement of at least 5% of a bristle length of the roller brush bristles with the floor surface. Additionally or alternatively, a center of gravity of the robot may be located forward of the drive axis, allowing the robot body to pivot forward about the drive wheels.

In some implementation, the robot includes at least one clearance regulator disposed on the robot body forward of the drive wheels. The clearance regulator maintains a minimum clearance height (e.g., at least 2 mm) between a bottom surface of the robot body and the floor surface. The clearance regulator(s) may be disposed forward of the drive wheels and rearward of the cleaning element(s). Additionally or alternatively, the clearance regulator(s) is/are roller(s) rotatably supported by the robot body.

In some implementations, the at least one cleaning element includes a first roller brush rotatably supported by the robot body. The first roller brush includes a brush core defining a longitudinal axis of rotation, and at least two longitudinal rows of bristles circumferentially spaced about the brush core. Each bristle extends away from a first end attached to the brush core to a second end unattached from the brush core. The bristles all have substantially the same length. The cleaning element further includes a second roller brush rotatably supported by the robot body rearward of the first roller brush. The second roller brush includes a brush core defining a longitudinal axis of rotation, and at least two longitudinal dual-rows of bristles circumferentially spaced about the brush core. Each dual-row of bristles includes a first row of bristles having a first bristle length, and a second row of bristles adjacent and parallel the first bristle row and having a second bristle length different from the first bristle length. The first and second bristle rows of each dual-row of bristles are separated circumferentially along the brush core by a cord distance of less than about ¼ the first length. Moreover, each bristle extends away from a first end attached to the brush core to a second end unattached from the brush core. In some examples, the cleaning system includes first and second brush motors. The first brush motor is coupled to the first roller brush and drives the first roller brush in a first direction. The second brush motor is coupled to the second roller brush and drives the second roller brush in a second direction opposite the first direction.

Yet another aspect of the disclosure provides a mobile surface cleaning robot including a robot body having a forward drive direction and a drive system supporting the robot body above a floor surface for maneuvering the robot across the floor surface. The drive system includes right and left drive wheel assemblies disposed on corresponding right and left portions of the robot body. Each drive wheel assembly has a drive wheel, a drive wheel suspension arm having a first end rotatably coupled to the robot body and a second end rotatably supporting the drive wheel, and drive wheel suspension spring biasing the drive wheel toward the floor surface. The drive system further includes at least one clearance regulator disposed forward of the drive wheels to maintain a minimum clearance height between a bottom surface of the robot body and the floor surface. The drive system further includes a caster wheel assembly disposed rearward of the drive wheels and includes a caster wheel supported for vertical movement and a suspension spring biasing the caster wheel toward the floor surface. The robot further includes a robot controller in communication with the drive system, and a cleaning system supported by the robot body forward of the drive wheels. The cleaning system includes at least one roller brush configured to engage the floor surface and having bristles. The suspension spring has a spring constant sufficient to elevate a rear end of the robot body above the floor surface to maintain engagement of the at least one roller brush with the floor surface. In some examples, a forward portion of the robot body has a flat forward face and a rearward portion of the robot body defines a semi-circular shape.

In some implementations, the suspension springs support the robot body a height above the floor surface that causes engagement of at least 5 of a bristle length of the roller brush bristles with the floor surface. Additionally or alternatively, the drive wheel suspension arm may have a length equal to between 70% and 150% of a height of the robot body. The first end of the drive wheel suspension arm may be disposed on the robot body below half the height of the robot body. Additionally, the drive wheel suspension springs together provide a spring force equal to between 40% and 80% of an overall weight of the robot. Each drive wheel may have a diameter equal to between 70-120% of the height of the robot body.

In some implementations, the caster wheel suspension spring elevates the rear end of the robot body above the floor surface to cause engagement of at least 5% of a bristle length of the roller brush bristles with the floor surface. A center of gravity of the robot may be located forward of the drive wheels, allowing the robot body to pivot forward about the drive wheels.

The minimum clearance height may be at least 2 mm. In some examples the clearance regulator(s) is/are disposed forward of the drive wheels and rearward of the roller brush(es). Additionally or alternatively, the clearance regulator may be a roller rotatably supported by the robot body.

In some implementations, the at least one cleaning element includes a first roller brush rotatably supported by the robot body. The first roller brush includes a brush core defining a longitudinal axis of rotation, and at least two longitudinal rows of bristles circumferentially spaced about the brush core. Each bristle extends away from a first end attached to the brush core to a second end unattached from the brush core. The bristles all have substantially the same length. The cleaning element further includes a second roller brush rotatably supported by the robot body rearward of the first roller brush. The second roller brush includes a brush core defining a longitudinal axis of rotation, and at least two longitudinal dual-rows of bristles circumferentially spaced about the brush core. Each dual-row of bristles includes a first row of bristles having a first bristle length, and a second row of bristles adjacent and parallel the first bristle row and having a second bristle length different from the first bristle length. The first and second bristle rows of each dual-row of bristles are separated circumferentially along the brush core by a cord distance of less than about ¼ the first length. Moreover, each bristle extends away from a first end attached to the brush core to a second end unattached from the brush core.

In some implementations, the first bristle length is less than 90% of the second bristle length. The first bristle row of each dual-row of bristles may be forward of the second bristle row in the direction of rotation of the second roller brush.

The first roller brush may include vanes arranged between and substantially parallel to the rows of bristles. Each vane includes an elastomeric material that extends from a first end attached to the brush core to a second end unattached from the brush core. The vanes may be shorter than the bristles. Additionally or alternatively, the second roller brush may include vanes arranged between and substantially parallel to the dual-rows of bristles. Each vane including an elastomeric material that extends from a first end attached to the brush core to a second end unattached from the brush core, the vanes being shorter than the bristles. The rows of bristles of each roller brush may each define a chevron shape arranged longitudinally along the corresponding brush core.

The robot may further include first and second brush motors. The first brush motor may be coupled to the first roller brush and may drive the first roller brush in a first direction. The second brush motor may be coupled to the second roller brush and may drive the second roller brush in a second direction opposite the first direction. The first direction of rotation may be a forward rolling direction with respect to the forward drive direction.

In some implementations, each brush core defines a longitudinally extending T-shaped channel for releasably receiving a brush element. The brush element includes an anchor defining a T-shape and complimentary sized for slidable receipt into the T-shaped channel, and at least one longitudinal row of bristles or a vane attached to the anchor. The brush element may include a dual-row of bristles attached to the anchor. In some examples, the brush core defines multiple equidistantly circumferentially spaced T-shaped channels.

In some implementations, the cleaning system further includes a brush bar arranged parallel to and engaging the bristles of one or both of the roller brushes. The brush bar interferes with rotation of the engaged roller brush to strip fibers from the engaged bristles. Additionally or alternatively, the cleaning system may include a collection volume disposed on the robot body, a plenum arranged over the first and second roller brushes, and a conduit in pneumatic communication with the plenum and the collection volume.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

An autonomous robot movably supported can clean a surface while traversing that surface. The robot can remove debris from the surface by agitating the debris and/or lifting the debris from the surface by applying a negative pressure (e.g., partial vacuum) above the surface, and collecting the debris from the surface.

Figure 1:
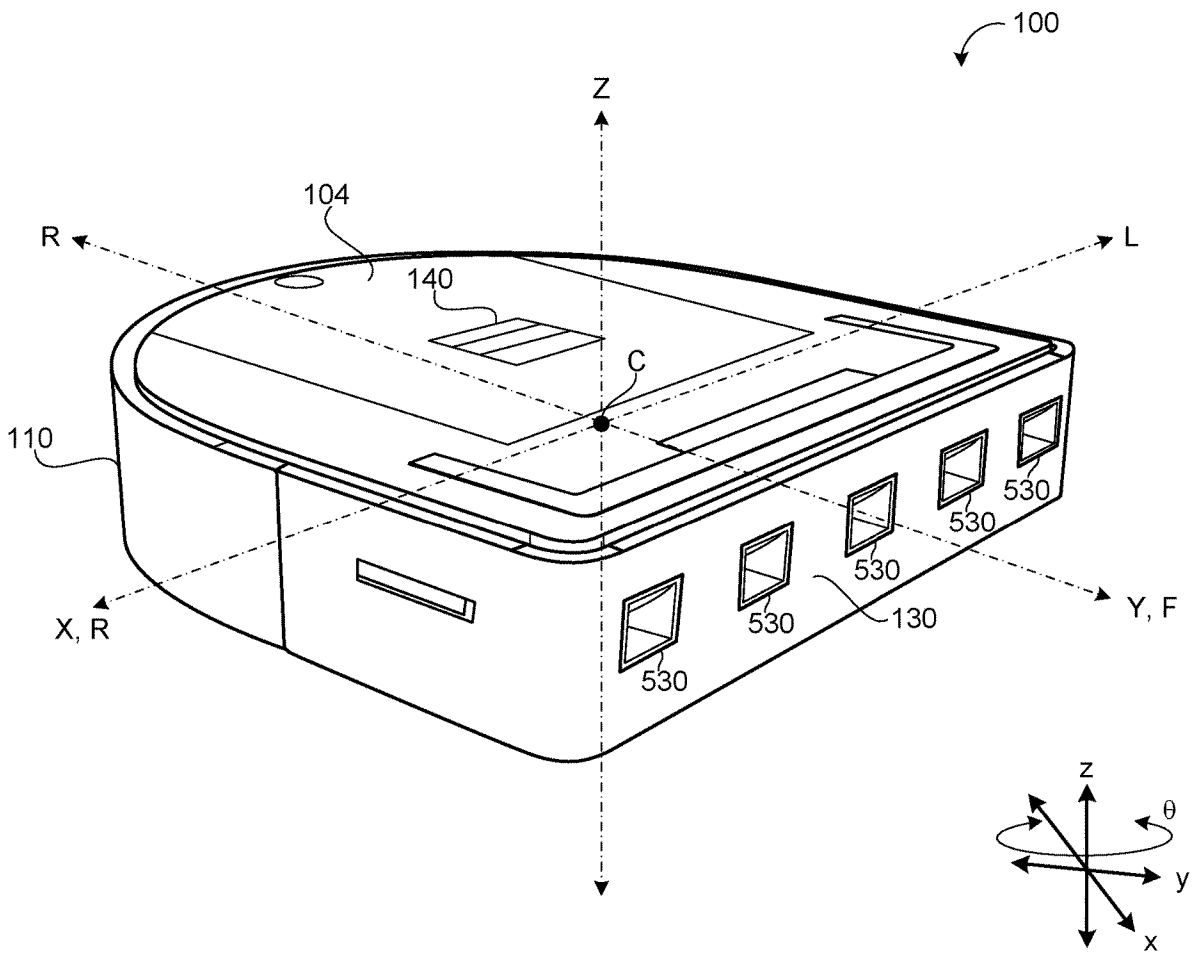
FIG. 1 is a perspective view of an exemplary cleaning robot.
Figure 2:
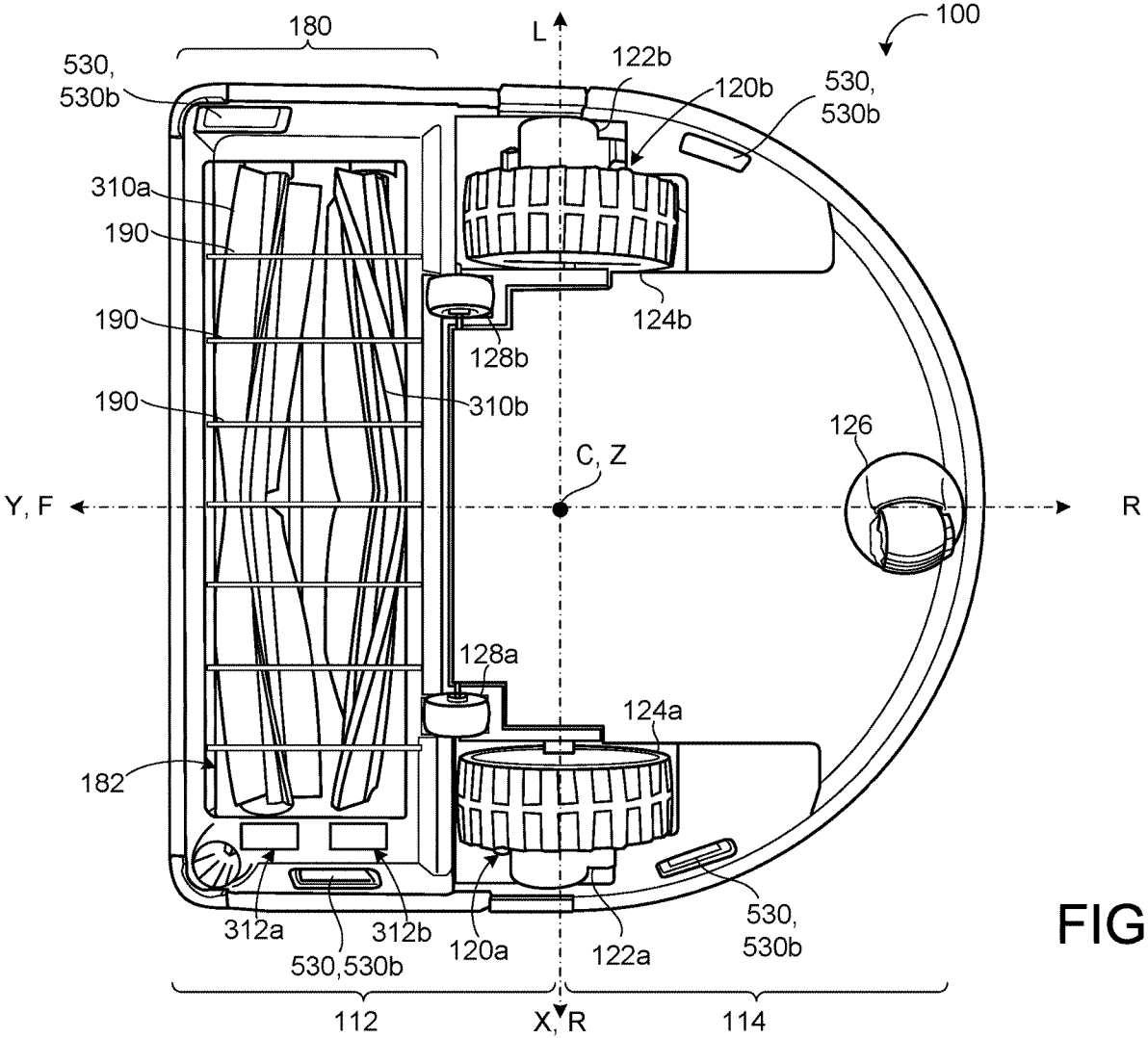
FIG. 2 is a bottom view of the robot shown in FIG. 1.
Figure 3:
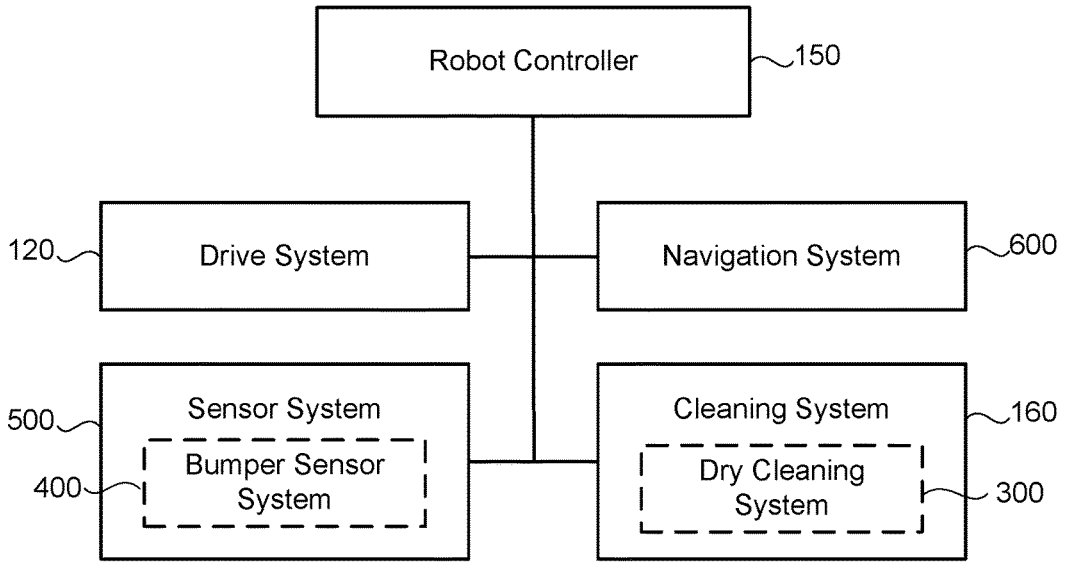
FIG. 3 is schematic view of an exemplary robotic system.

Referring to FIGS. 1-3, in some implementations, a robot 100 includes a body 110 supported by a drive system 120 that can maneuver the robot 100 across the floor surface 10 based on a drive command having x, y, and θ components, for example. The robot body 110 has a forward portion 112 and a rearward portion 114. The drive system 120 includes right and left driven wheel modules 120*a*, 120*b*. The wheel modules 120*a*, 120*b* are substantially opposed along a transverse axis X defined by the body 110 and include respective drive motors 122*a*, 122*b* driving respective wheels 124*a*, 124*b*. The drive motors 122*a*, 122*b* may releasably connect to the body 110 (e.g., via fasteners or tool-less connections) with the drive motors 122*a*, 122*b* optionally positioned substantially over the respective wheels 124*a*, 124*b*. The wheel modules 120*a*, 120*b* can be releasably attached to the chassis 110 and forced into engagement with the floor surface 10 by respective springs. The robot 100 may include a caster wheel 126 disposed to support a rearward portion 114 of the robot body 110. The robot body 110 supports a power source 102 (e.g., a battery) for powering any electrical components of the robot 100.

In some examples, the wheel modules 120*a*, 120*b* are movable secured (e.g., rotatably attach) to the robot body 110 and receive spring biasing (e.g., between about 5 and 25 Newtons) that biases the drive wheels 124*a*, 124*b* downward and away from the robot body 110. For example, the drive wheels 124*a*, 124*b* may receive a downward bias of about 10 Newtons when moved to a deployed position and about 20 Newtons when moved to a retracted position into the robot body 110. The spring biasing allows the drive wheels 124*a*, 124*b* to maintain contact and traction with the floor surface 10 while any cleaning elements of the robot 100 contact the floor surface 10 as well.

The robot 100 can move across the floor surface 10 through various combinations of movements relative to three mutually perpendicular axes defined by the body 110: a transverse axis X, a fore-aft axis Y, and a central vertical axis Z. A forward drive direction along the fore-aft axis Y is designated F (sometimes referred to hereinafter as "forward"), and an aft drive direction along the fore-aft axis Y is designated A (sometimes referred to hereinafter as "rearward"). The transverse axis X extends between a right side R and a left side L of the robot 100 substantially along an axis defined by center points of the wheel modules 120*a*, 120*b*.

Figure 12A:
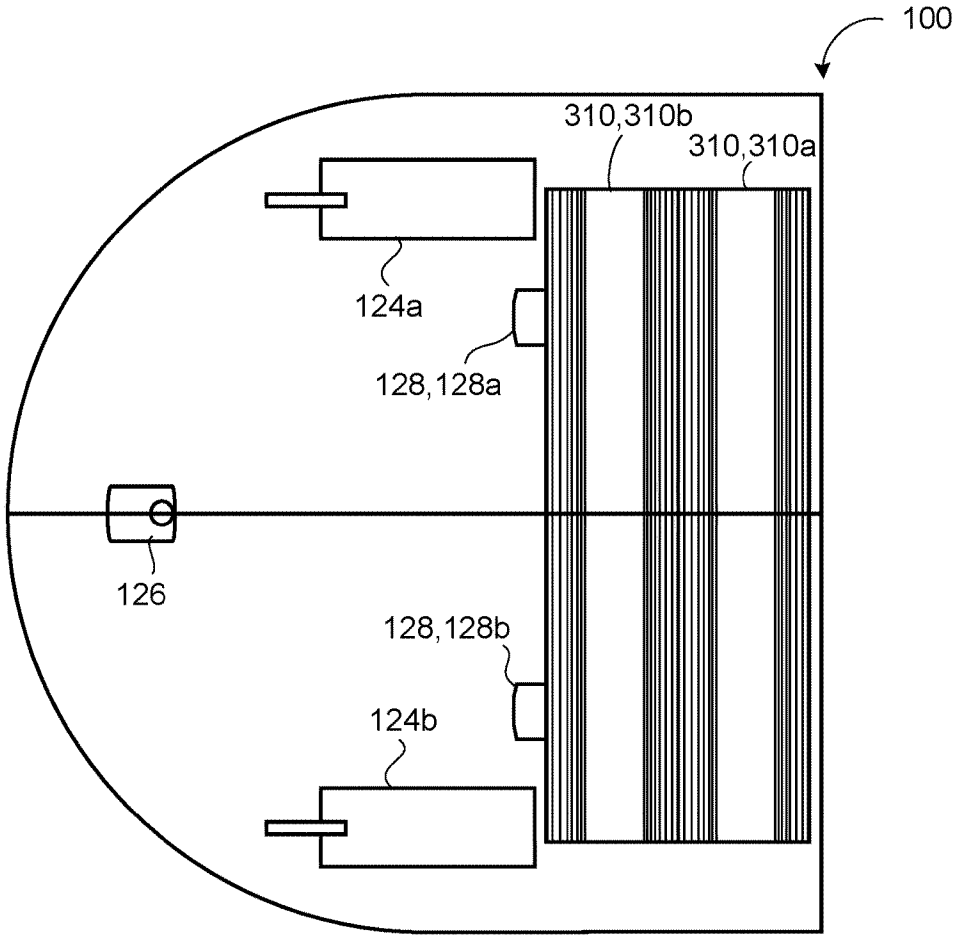
FIG. 12A is a bottom schematic view of an exemplary cleaning robot.
Figure 12B:
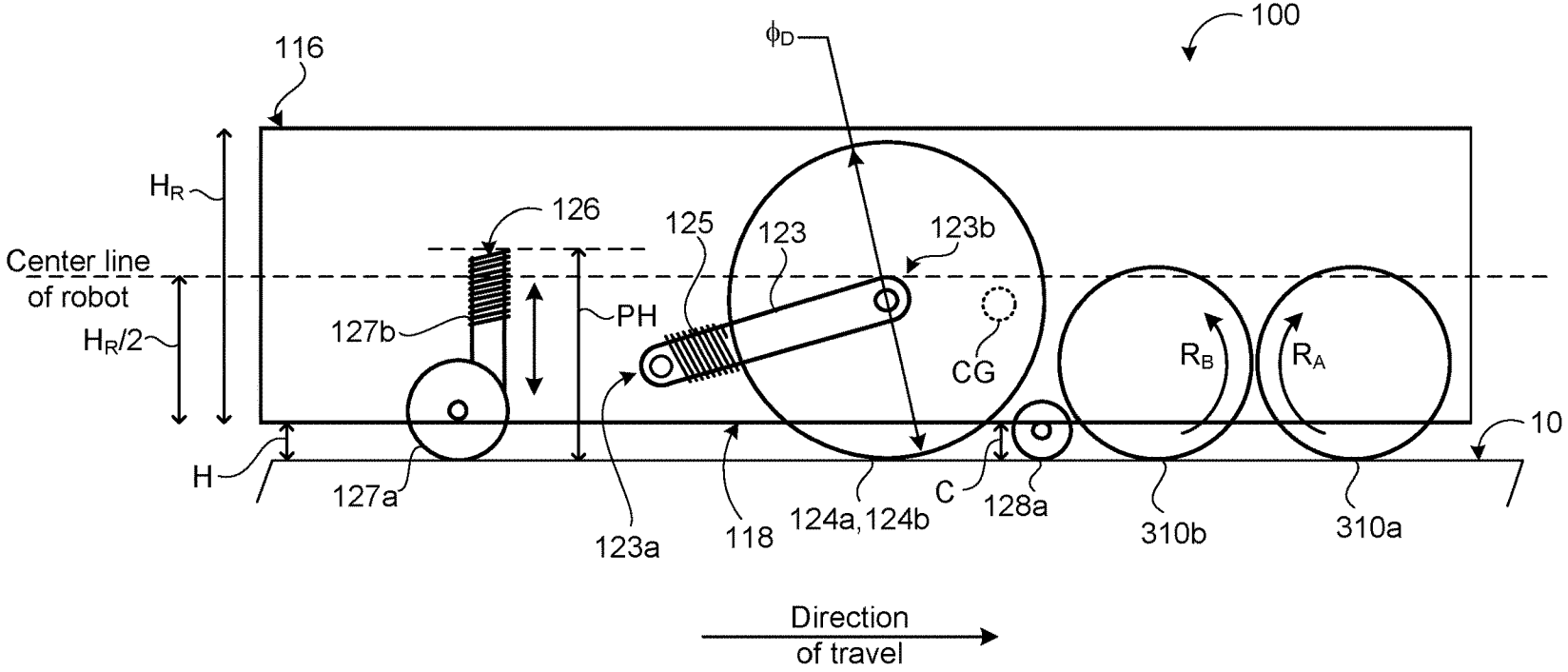
FIG. 12B is a side schematic view of an exemplary cleaning robot.

Referring to FIGS. 2 and 12B, in some implementations, the robot 100 weighs about 10-60 N empty. The robot 100 may have a center of gravity up to 35% of the distance from the transverse axis X (e.g., a centerline connecting the drive wheels 124*a*, 124*b*) to the front of the robot 100 (i.e. the forward surface facing the direction of travel). The robot 100 may rely on having most of its weight over the drive wheels 124*a*, 124*b* to ensure good traction and mobility on surfaces 10. Moreover, the caster 126 disposed on the rearward portion 114 of the robot body 110 can support between about 0-25% of the robot's weight, and the caster 126 rides on a hard stop while the robot 100 is mobile. The robot 100 may include one or more clearance regulators 128*a*, 128*b*, such as right and left non-driven wheel 128*a*, 128*b* rotatably supported by the robot body 110 adjacent to and forward of the drive wheels 124*a*, 124*b* for supporting between about 0-25% of the robot's weight and for ensuring the forward portion 112 of the robot 100 doesn't sit on the ground when accelerating.

A forward portion 112 of the body 110 carries a bumper 130, which detects (e.g., via one or more sensors) one or more events in a drive path of the robot 100, for example, as the wheel modules 120*a*, 120*b* propel the robot 100 across the floor surface 10 during a cleaning routine. The robot 100 may respond to events (e.g., obstacles, cliffs, walls) detected by the bumper 130 by controlling the wheel modules 120*a*, 120*b* to maneuver the robot 100 in response to the event (e.g., away from an obstacle). While some sensors are described herein as being arranged on the bumper, these sensors can be additionally or alternatively arranged at any of various different positions on the robot 100.

A user interface 140 disposed on a top portion of the body 110 receives one or more user commands and/or displays a status of the robot 100. The user interface 140 is in communication with a robot controller 150 carried by the robot 100 such that one or more commands received by the user interface 140 can initiate execution of a cleaning routine by the robot 100.

Figure 4:
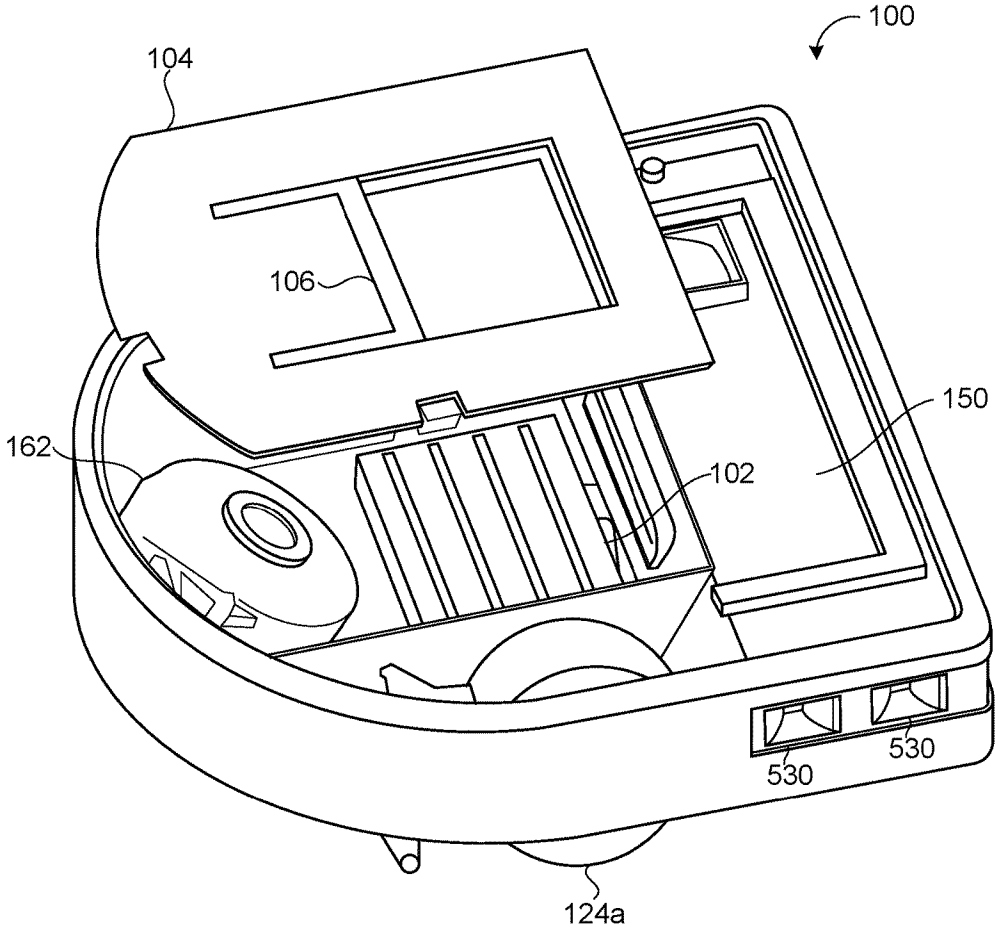
FIG. 4 is a partial exploded view of an exemplary cleaning robot.
Figure 5:
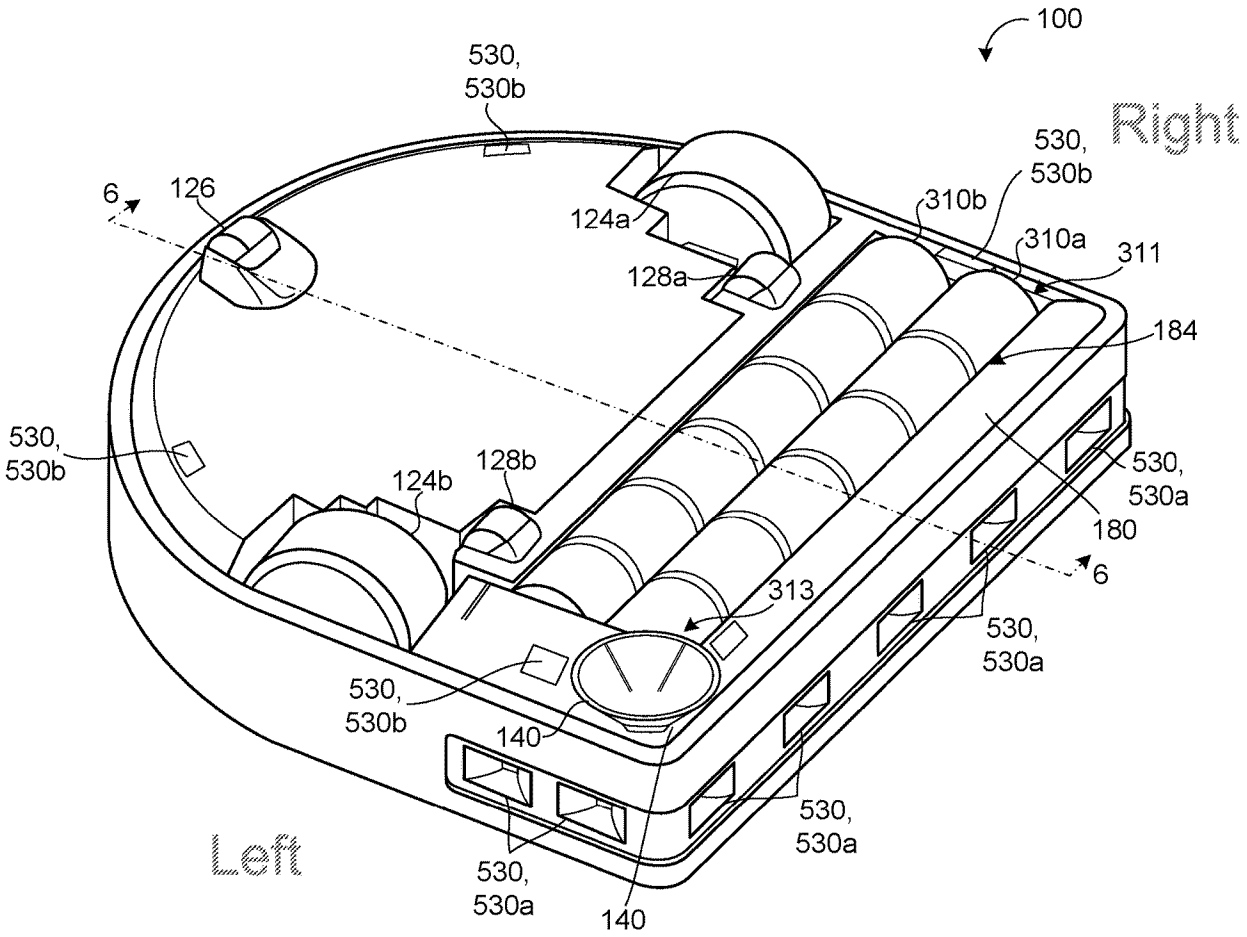
FIG. 5 is a bottom perspective view of the robot shown in FIG. 5.

Referring to FIGS. 3-5, to achieve reliable and robust autonomous movement, the robot 100 may include a sensor system 500 having several different types of sensors 530 which can be used in conjunction with one another to create a perception of the robot's environment sufficient to allow the robot 100 to make intelligent decisions about actions to take in that environment. The sensor system 500 may include obstacle detection obstacle avoidance (ODOA) sensors, communication sensors, navigation sensors, etc. In some implementations, the sensor system 500 includes ranging sonar sensors 530*a* (e.g., disposed on the forward body portion 112), proximity cliff sensors 530*b* (e.g., infrared sensors), contact sensors, a laser scanner, and/or an imaging sonar. Additionally or alternatively, the sensors 530 may include, but not limited to, proximity sensors, sonar, radar, LIDAR (Light Detection And Ranging, which can entail optical remote sensing that measures properties of scattered light to find range and/or other information of a distant target), LADAR (Laser Detection and Ranging), etc., infrared cliff sensors, contact sensors, a camera (e.g., volumetric point cloud imaging, three-dimensional (3D) imaging or depth map sensors, visible light camera and/or infrared camera), etc.

The robot controller 150 (executing a control system) may execute behaviors that cause the robot 100 to take an action, such as maneuvering in a wall following manner, a floor scrubbing manner, or changing its direction of travel when an obstacle is detected (e.g., by a bumper sensor system 400). The robot controller 150 can maneuver the robot 100 in any direction across the floor surface 10 by independently controlling the rotational speed and direction of each wheel module 120*a*, 120*b*. For example, the robot controller 150 can maneuver the robot 100 in the forward F, reverse (aft) A, right R, and left L directions. As the robot 100 moves substantially along the fore-aft axis Y, the robot 100 can make repeated alternating right and left turns such that the robot 100 rotates back and forth around the center vertical axis Z (hereinafter referred to as a wiggle motion). The wiggle motion can allow the robot 100 to operate as a scrubber during cleaning operation. Moreover, the wiggle motion can be used by the robot controller 150 to detect robot stasis. Additionally or alternatively, the robot controller 150 can maneuver the robot 100 to rotate substantially in place such that the robot 100 can maneuver-away from an obstacle, for example. The robot controller 150 may direct the robot 100 over a substantially random (e.g., pseudo-random) path while traversing the floor surface 10. The robot controller 150 can be responsive to one or more sensors 530 (e.g., bump, proximity, wall, stasis, and/or cliff sensors) disposed about the robot 100. The robot controller 150 can redirect the wheel modules 120*a*, 120*b* in response to signals received from the sensors 530, causing the robot 100 to avoid obstacles and clutter while treating the floor surface 10. If the robot 100 becomes stuck or entangled during use, the robot controller 150 may direct the wheel modules 120*a*, 120*b* through a series of escape behaviors so that the robot 100 can escape and resume normal cleaning operations.

Referring to FIG. 3, in some implementations, the robot 100 includes a navigation system 600 configured to maneuver the robot 100 in a pseudo-random pattern across the floor surface 10 such that the robot 100 is likely to return to the portion of the floor surface 10 upon which cleaning fluid has remained. The navigation system 600 may be a behavior based system stored and/or executed on the robot controller 150. The navigation system 600 may communicate with the sensor system 500 to determine and issue drive commands to the drive system 120.

Referring to FIGS. 2-8, in some implementations, the robot 100 includes a cleaning system 160 having a cleaning subsystem 300, such as a dry cleaning system 300. The dry cleaning system 300 includes at least one roller brush 310 (e.g., with bristles and/or beater flaps) extending parallel to the transverse axis X and rotatably supported by the robot body 110 to contact the floor surface 10. The brush 310 includes first and second ends 311, 313, each end is releasably connected to the robot body 110. The cleaning system 160 includes a cleaning head 180 for receiving the roller brush 310. The roller brush 310 may be releasably connected to the cleaning head 180. In the example shown, the cleaning head 180 is positioned in the forward portion 112 of the robot body 110. In some examples, the cleaning head 180 defines a recess 184 having a rectangular shape for receiving the roller brush(es) 310. The recess 184 allows the brush(es) 310 to be in contact with a floor surface 10 for cleaning. The cleaning head 180 also defines a plenum 182 arranged over the roller brush 310. A conduit or ducting 208 provides pneumatic communication between the plenum 182 and the collection volume 202*b*.

The roller brush 310*a*, 310*b* may be driven by a corresponding brush motor 312*a*, 312*b* or by one of the wheel drive motors 122*a*, 122*b*. The driven roller brush 310 agitates debris on the floor surface 10, moving the debris into a suction path for evacuation to the collection volume 202*b*. Additionally or alternatively, the driven roller brush 310 may move the agitated debris off the floor surface 10 and into a collection bin (not shown) adjacent the roller brush 310 or into one of the ducting 208. The roller brush 310 may rotate so that the resultant force on the floor 10 pushes the robot 100 forward. The robot body 110 may include a removable cover 104 allowing access to the collection bin, and may include a handle 106 for releasably accessing the collection volume 202*b*.

In some implementations, the robot body 110 includes a side brush 140 disposed on the bottom forward portion 112 of the robot body 110. The side brush 140 agitates debris on the floor surface 10, moving the debris into the suction path of a vacuum module 162. In some examples, the side brush 140 extends beyond the robot body 110 allowing the side brush 140 to agitate debris in hard to reach areas such as corners and around furniture.

Figure 9:
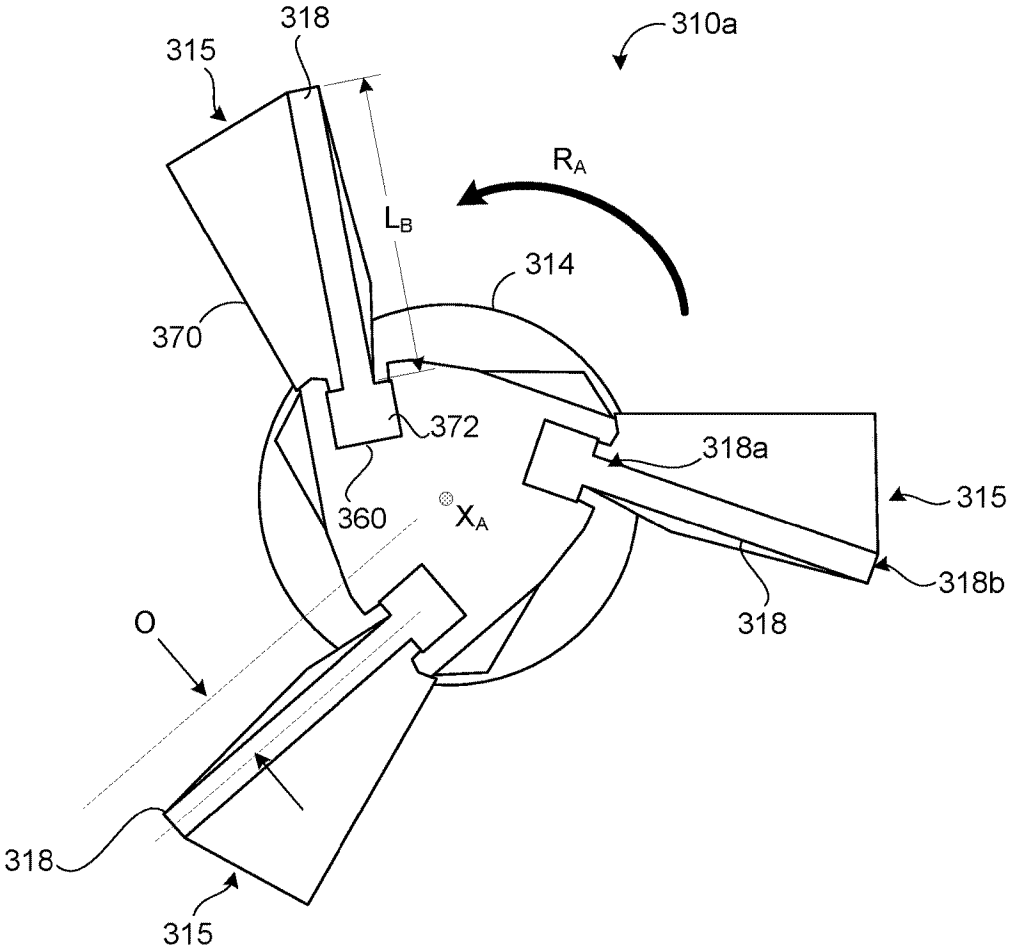
FIG. 9 is a side view of an exemplary roller brush.
Figure 10A:
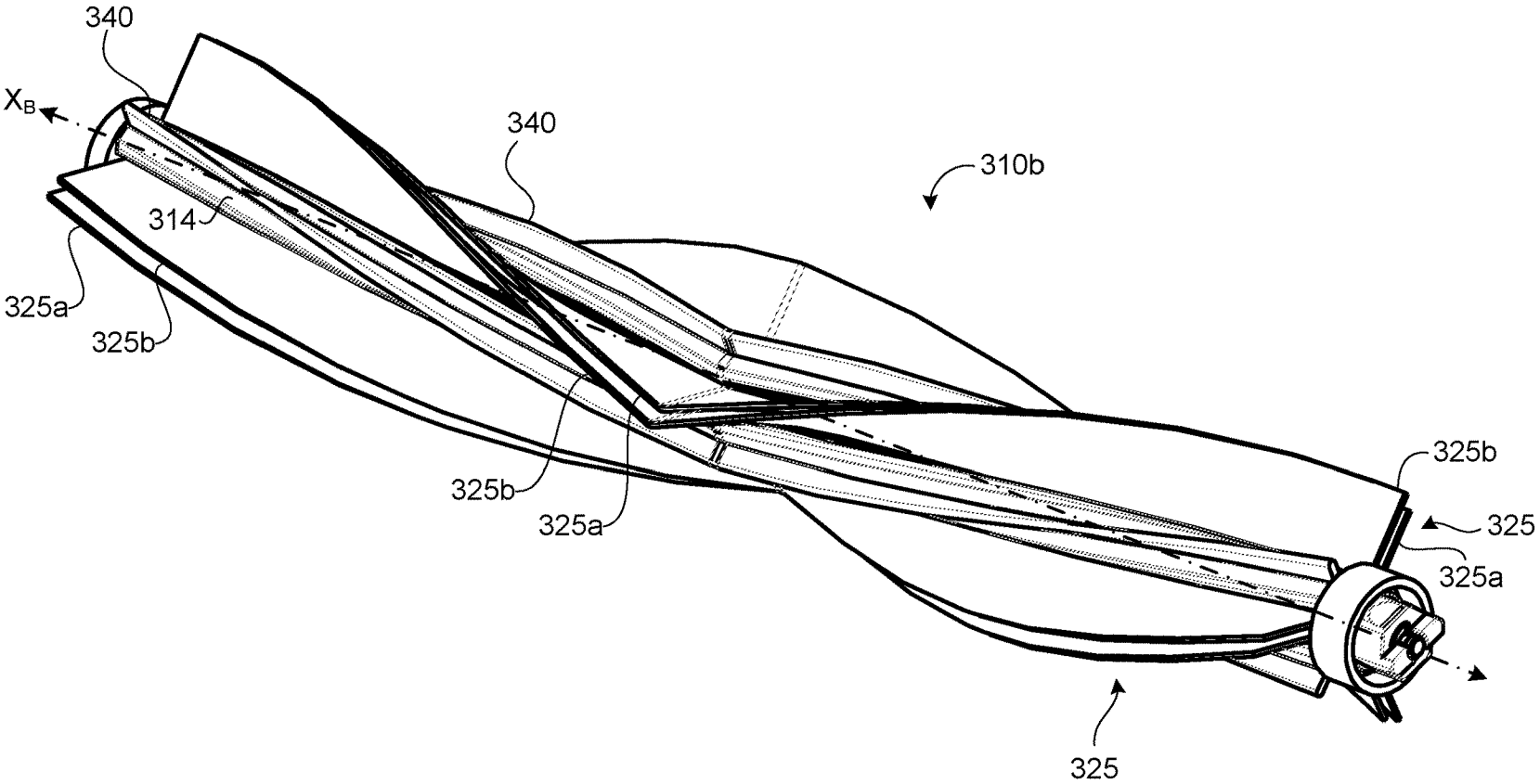
FIG. 10A is a perspective view of an exemplary roller brush having dual-rows of bristles.
Figure 10B:
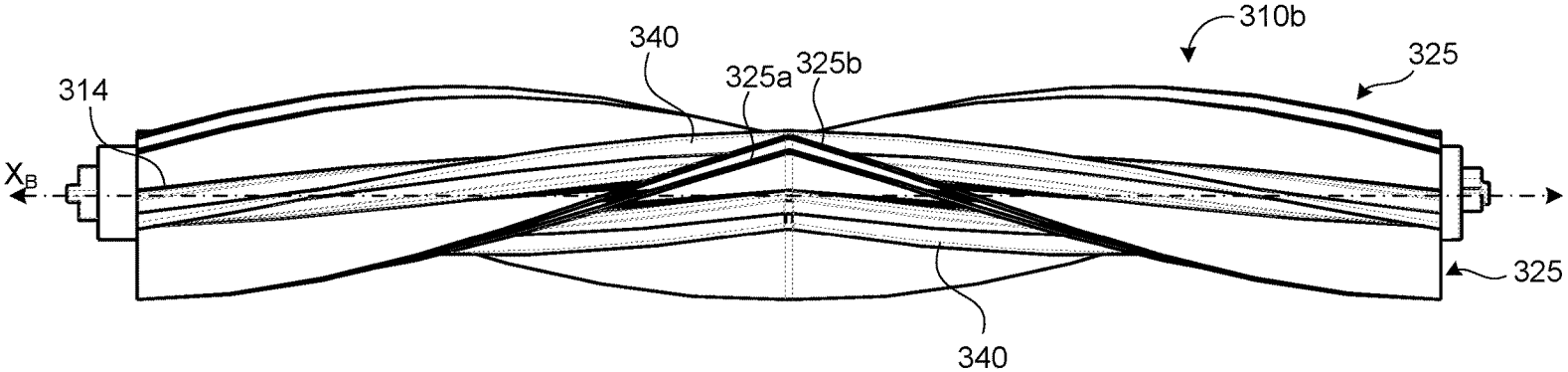
FIG. 10B is a front view of the roller brush of FIG. 10A.
Figure 10C:
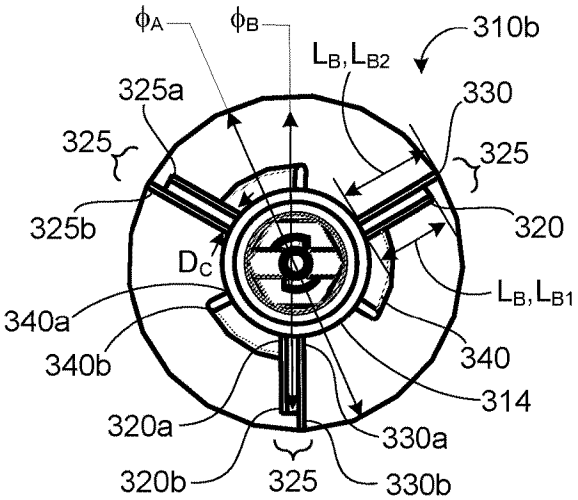
FIG. 10C is a side view of the roller brush of FIG. 10A.

Referring to FIGS. 9-10C, in some implementations, the cleaning system 160 includes first and second roller brushes 310*a*, 310*b*. The brushes 310*a*, 310*b* rotate simultaneously to remove dirt from a surface 10. Each brush 310*a*, 310*b* includes a brush core 314 defining a longitudinal axis of rotation $X_A$, $X_B$. The brushes 310*a*, 310*b* rotate simultaneously about their longitudinal axes of rotation $X_A$, $X_B$ to remove dirt from a surface 10. Moreover, the brushes 310*a*, 310*b* may rotate in in the same or opposite directions about their respective longitudinal axis $X_A$, $X_B$. In some examples, the robot 100 includes first and second brush motors 312*a*, 312*b*. The first brush motor 312*a* is coupled to the first roller brush 310*a* and drives the first roller brush 310*a* in a first direction. The second brush motor 312*b* is coupled to the second roller brush 310*b* and drives the second roller brush 310*b* in a second direction opposite the first direction. The first direction of rotation may be a forward rolling direction with respect to the forward drive direction F.

Figure 6:
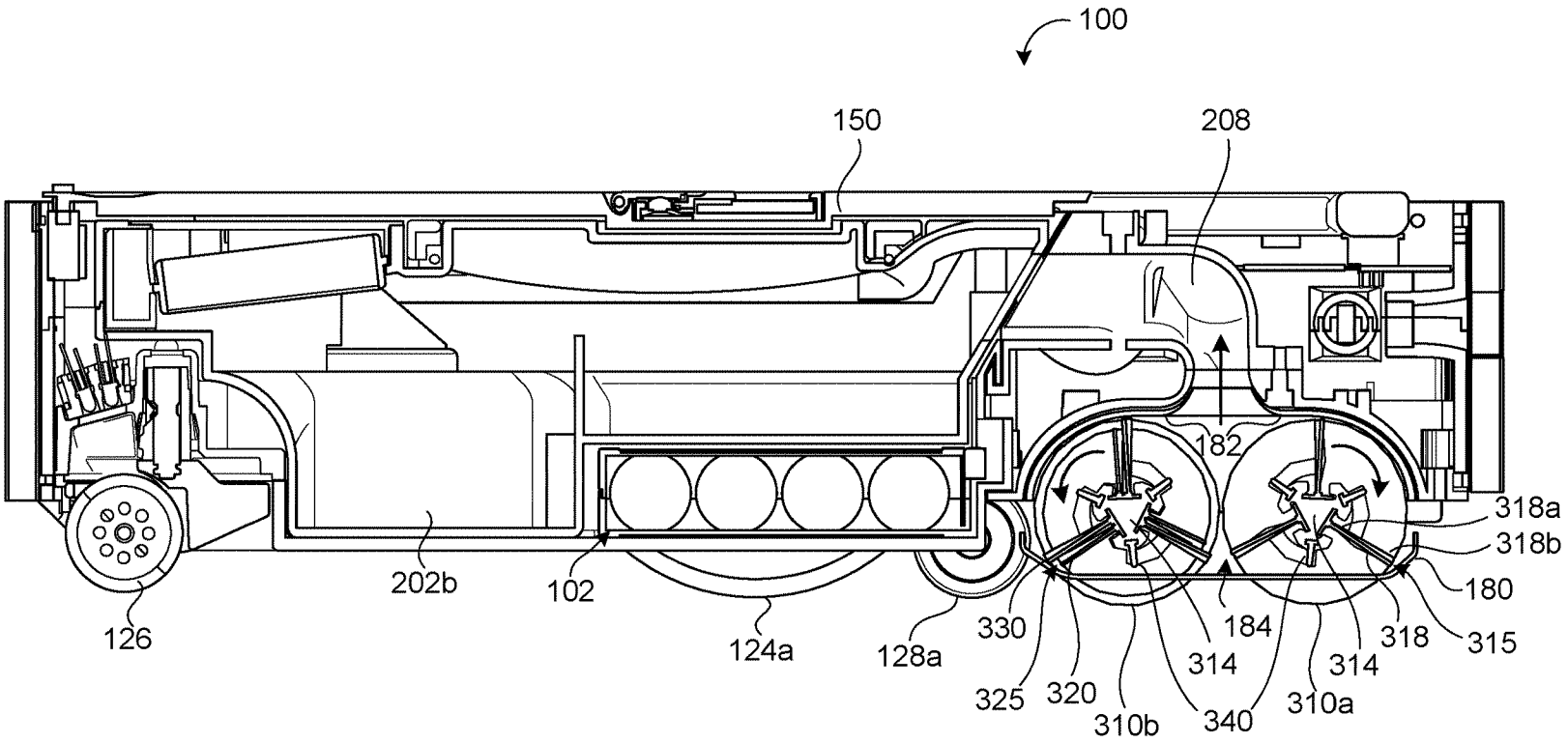
FIG. 6 is a section view of the robot shown in FIG. 4, along line 6-6.
Figure 7:
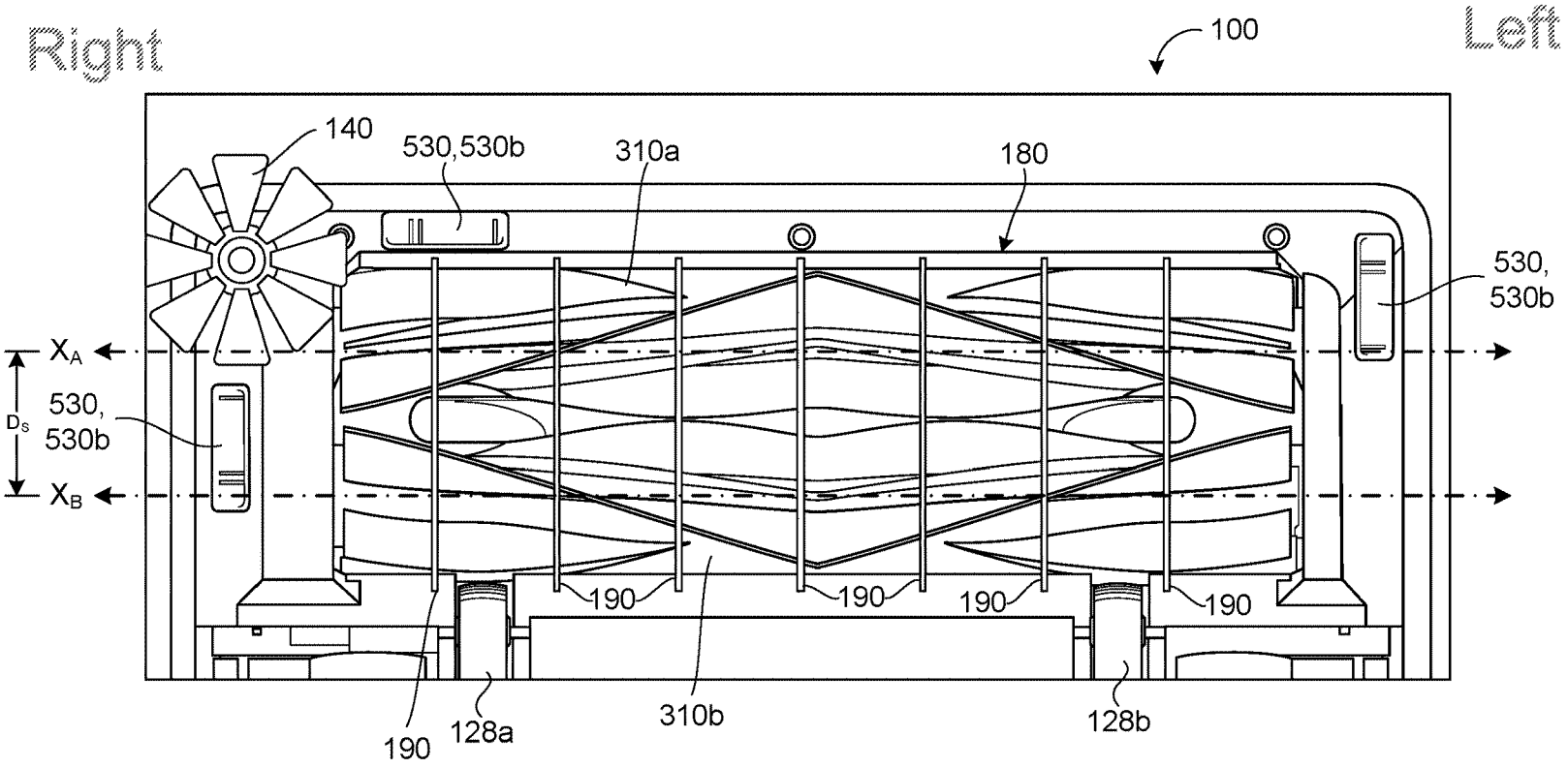
FIG. 7 is a partial bottom view of the brushes of an exemplary cleaning robot.
Figure 8:
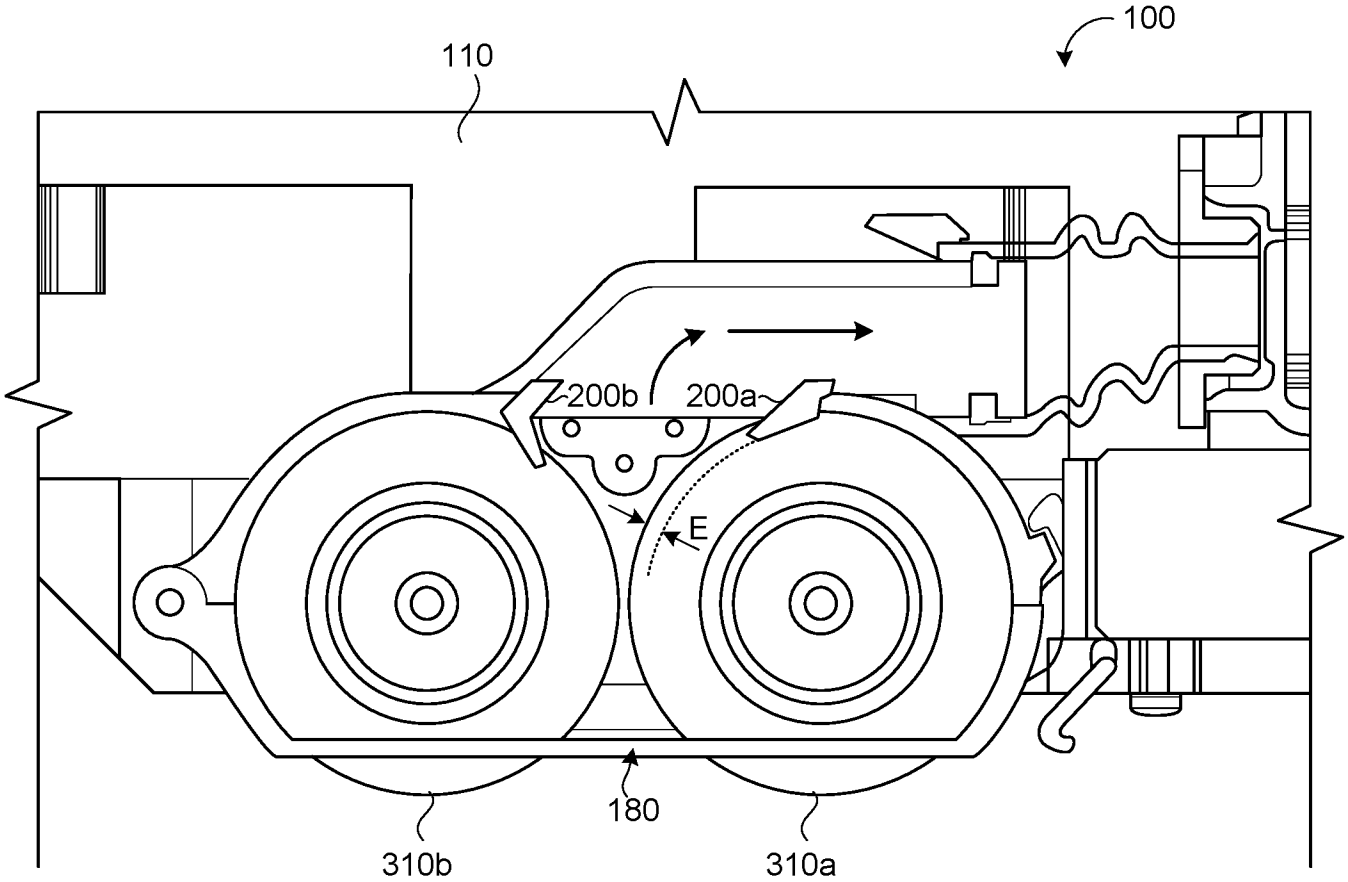
FIG. 8 is a partial section view of an exemplary cleaning robot, illustrating a brush bar arrangement.

Referring to FIGS. 6 and 9, in some implementations, the first roller brush 310*a* includes at least two longitudinal rows 315 of bristles 318 circumferentially spaced about the brush core 314. Each bristle 318 extends away from a first end 318*a* attached to the brush core 314 to a second end 318*b* unattached from the brush core 314. The bristles 318 may all have substantially the same length $L_B$.

Referring to FIGS. 6 and 10A-10C, in some implementations, the second roller brush 310*b* includes at least two longitudinal dual-rows 325 of bristles 320, 330 circumferentially spaced about the brush core 314. Each dual-row 325 has a first row 325*a* of bristles 320 having a first bristle length $L_{B1}$ and a second row 325*b* of bristles 330 adjacent and parallel the first bristle row 325*a* and having a second bristle length $L_{B2}$ different from the first bristle length $L_{B1}$ (e.g., the second bristle length $L_{B2}$ is greater than the first bristle length $L_{B1}$). The first and second bristle rows 325*a*, 325*b* are separated circumferentially along the brush core 314 by narrow gap. In some examples, a cord distance $D_C$ is less than about ¼ the first bristle length $L_{B1}$. In addition, each bristle 320, 330 may extend away from a first end 320*a*, 330*a* attached to the brush core 314 to a second end 320*b*, 330*b* unattached from the brush core 314. In some examples, the first bristle length $L_{B1}$ is less than 90% of the second bristle length $L_{B2}$. Additionally or alternatively, the first bristle row 325*a* of each dual-row 325 of bristles 320, 330 may be forward of the second row 325*b* of bristles 330 in the direction of rotation $R_B$ of the second roller brush 310*b*.

In some implementations of the second roller brush 310*b*, the first row 325*a* of bristles 320 is formed of a first bristle composition and the second row 325*b* of bristles 330 is formed of a second bristle composition, and the first bristle composition is stiffer than the second bristle composition. The first bristle length $L_{B1}$ may be no more than 90% of second bristle length $L_{B2}$, and the first row 325*a* and second row 325*b* may be separated by a narrow gap of no more than 10% of second bristle length $L_{B2}$ (i.e. no more 10% of the length of the longer bristles 330). In some examples, the second roller brush 310*b* has three or more dual rows of bristles 320, 330 equidistantly separated along the circumference of the brush core by 60 to 120 degrees. Having more than five dual rows 325 is costly and also results in excessive power draw on the motor driving the second roller brush 310*b*. Having fewer than three dual rows 325 results in poor cleaning performance because the bristles 330 do not contact the surface being cleaned with sufficient frequency.

The first roller brush 310*a* may include three or more rows of single height bristles 318. Additionally or alternatively, the first roller brush 310*a* may include one or more dual-rows 325 of bristles 320, 330 identical to those shown and described herein with reference to the second roller brush 310 of FIG. 10C.

Referring again to FIGS. 7 and 9, a bristle offset O in a brush 310 is how far forward or behind the center axis $X_A$, $X_B$ of the brush 310 the bristles 318, 320, 330 are mounted with respect to the intended direction $R_A$ of brush 310 rotation. Bristles 318, 320, 330 mounted forward of the center axis $X_A$, $X_B$ will naturally be swept-back when contacting the floor 10, while bristles 318, 320, 330 mounted behind the center axis $X_A$, $X_B$ will drive the bristles 318, 320, 330 further into the floor 10(resulting in higher power consumption and the potential for "brush bounce"). Bristles 318, 320, 330 mounted in front of the center axis $X_A$, $X_B$ of the brush 310 yield longer bristles 318, 320, 330 for the same effective diameter, creating a brush 310 that is relatively less stiff. As a result, a current draw or power consumption while traversing and cleaning a carpeted floor surface 10 can be significantly reduced compared to a rear offset bristle configuration. In some implementations, the bristles 318, 320, 330 have an offset of between 0 and 3 mm (e.g., 1 mm) behind the center axis $X_A$, $X_B$ of the brush 310.

In some implementations, a spacing distance $D_S$, measured along the Y-axis, between the longitudinal axes of rotation $X_A$, $X_B$ is greater than or equal to a diameter $\phi_A$, $\phi_B$ of the brushes 310*a*, 310*b*. In some examples, the brushes 310*a*, 310*b* are spaced apart such that distal second ends 318*b*, 320*b*, 320*c* of their respective bristles 318, 320, 330 are distanced by a gap of about 1-10 mm.

Referring again to FIGS. 6, 9 and 10A-10C, in some implementations, one or both brushes 310*a*, 310*b* include vanes 340 arranged between and substantially parallel to the rows 315 of bristles 318 or dual-rows 325 of bristles 320, 330. Each vane 340 includes an elastomeric material that extends from a first end 340*a* attached to the brush core 314 to a second end 340*b* unattached from the brush core 314. The vanes 340 prevent hair from wrapping about the brush core 314. Additionally, the vanes 340 keep the hair towards the outer portion of the brush core 314 for easier removal and cleaning. The vanes 340 may extend in a straight line or define a chevron shape on the brush core 314. The vanes 340 may be shorter than the bristles 318, 320, 330. The vanes 340 facilitate the removal of hair wrapped around the brush core 314 because the vanes 340 prevent the hair from deeply wrapping tightly around the brush core 314. Additionally, the vanes 340 increase the airflow past the brushes 310*a*, 310*b*, which in turn increases the deposition of hair and other debris into the dust bin 202*b*. Since the hair is not deeply wrapped around the core 314 of the brush 310, the vacuum may still pull the hair off the brush 310.

In some implementations, each brush core 314 defines a longitudinally extending T-shaped channel 360 for releasably receiving a brush element 370. The brush element 370 includes an anchor 372 defining a T-shape and complimentary sized for slidable receipt into the T-shaped channel 360, and at least one longitudinal row of bristles 318, 320, 330 or a vane 340 attached to the anchor 372. The T-shaped anchor 372 allows a user to slide the brush element 370 on and off the brush core 314 for servicing, while also preventing escapement of the bristles during operation of the brush 310. In some examples, the channel 360 defines other shapes for releasably receiving a brush element 370 having a complimentary shape sized for slidably being received by the channel 360. The channels 360 may be equidistantly circumferentially spaced about the brush core 314.

Figure 11:
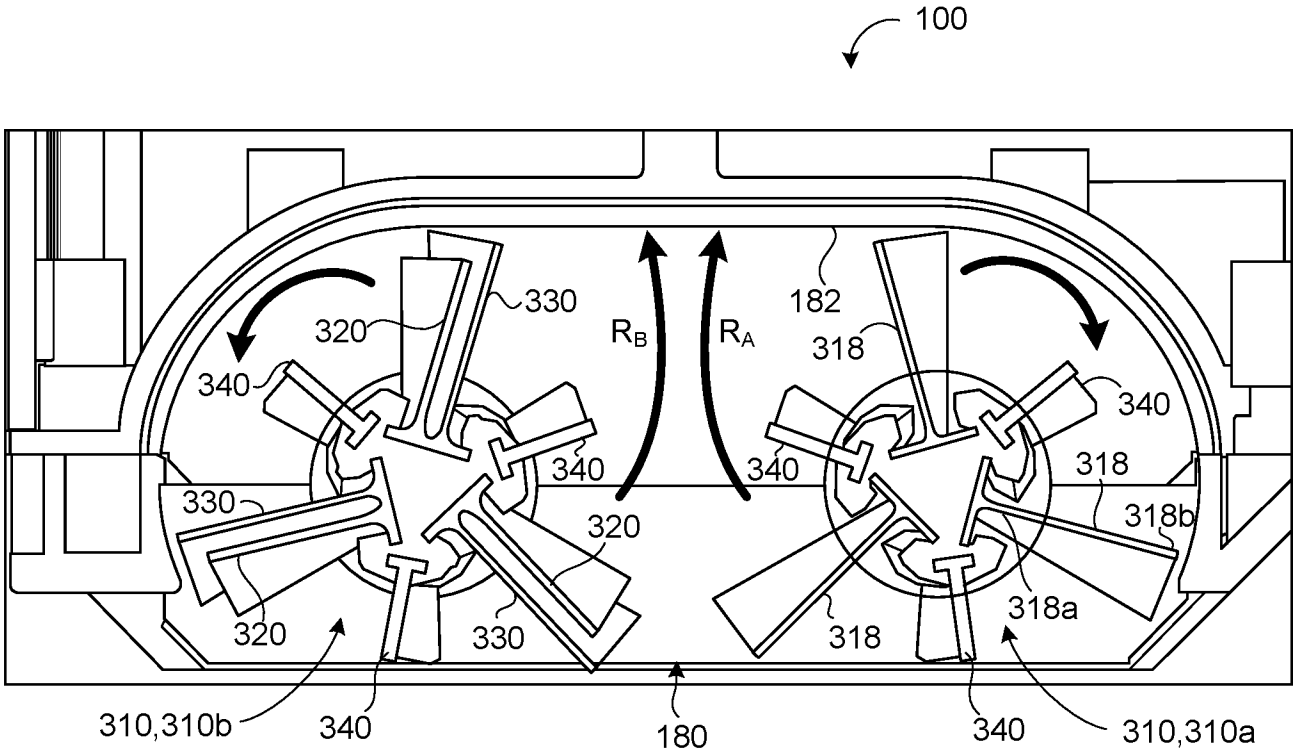
FIG. 11 is a partial section view of an exemplary dual-brush cleaning system.

Referring to FIG. 11, in some implementations, particularly those in which the robot 100 has high power consumption, as the plenum 182 accumulates debris, the brushes 310*a*, 310*b* may scrape the debris off the plenum 182, thus minimizing debris accumulation. In some examples, the dual-row 325 of bristles 320, 330 has a first row 325*a* a bristle diameter $\phi_A$ of 0.003-0.010 inches (e.g., 0.009 inches) adjacent and parallel to a second bristle row 325*b* having a bristle diameter $\phi_B$ of between 0.001-0.007 inches (e.g., 0.005 inches). The first bristle row 325*a* (the lesser diameter bristle row) is relatively stiffer than the second bristle row 325*b* (the larger diameter bristle row) to impede filament winding about the brush core 314. Moreover, the bristles 320, 330 of at least one of the bristle rows 325*a*, 325*b* may be long enough to interfere with the plenum 182 keeping the inside of the plenum 182 clean and allowing for a longer reach into transitions and grout lines on the floor surface 10. As the robot 100 picks up hair from the surface 10, the hair may not be directly transferred from the surface 10 to the collection bin 202*b*, but rather may require some time for the hair to migrate from the brush 310 and into the plenum 182 and then to the collection bin 202*b*. Denser and/or stiffer bristles 320, 330 may entrap the hair on the brush 310, causing relatively less deposition of the hair in the collection bin 202*b*. Thus, a combination of soft and stiff bristles 320, 330, where the soft bristles 330 are longer than the stiff bristles 320, allows the hair to be trapped in the longer soft bristles 330 and therefore migrate to the collection bin 202*b* faster. Additionally, the combination of denser and/or stiffer bristles 320, 330 enables retrieval of debris, particularly hair, from myriad surface types. The first s row of bristles 325*a* are effective at picking up debris from hard flooring and hard carpet. The soft bristles are better at being compliant and releasing collected hair into the plenum.

As the cleaning system 160 suctions debris from the floor surface 10, dirt and debris may adhere to the plenum 182 of the cleaning head 180. The cleaning head 180 may releasably connect to the robot body 110 and/or the cleaning system 160 to allow removal by the user to clean any accumulated dirt or debris from within the cleaning head 180. Rather than requiring significant disassembly of the robot 100 for cleaning, a user can remove the cleaning head 180 (e.g., by releasing tool-less connectors or fasteners) for emptying the collection volume 202*b* by grabbing and pulling a handle 106 located on the robot body 110.

Referring again to FIG. 7, in some implementations, the cleaning head includes a wire bail 190 to prevent larger objects (e.g., wires, cords, and clothing) from wrapping around the brushes. The wire bails may be located vertically or horizontally, or may include a combination of both vertical and horizontal arrangement.

Referring again to FIG. 8, in some implementations, the robot 100 includes at least one brush bar 200*a*, 200*b* arranged parallel to and engaging the bristles 318, 320, 330 of one of the roller brushes 310*a*, 310*b*. The brush bar(s) 200*a*, 200*b* interfere with the rotation of the engaged roller brush 310*a*, 310*b* to strip fibers or filaments from the engaged bristles 318, 320, 330. As the brushes 310*a*, 310*b* rotate to clean a floor surface 10, the bristles 318, 320, 330 make contact with the brush bar 200*a*, 200*b*. The brush bar(s) 200*a*, 200*b* agitate debris (e.g., hair) on the ends of the brushes 310*a*, 310*b* and swipes them into the vacuum airflow for deposition into the collection volume 202*b*. The roller brush 310 allows the robot 100 to increase its collection of debris specifically hair in the collection bin 202*b*, and reduce hair entangling on the brushes 310*a*, 310*b*. In some examples, a brush bar 200*a* interferes minimally with only the second bristle row 325*b* and does not interfere with the stiffer bristles of the first bristle row 325*a*. The brush bar 200*a*, 200*b* may interfere with the second end 330*b* of the softer bristles 330 of the second bristle row 325*b* and engage them by an engagement distance E, measured radially with respect to the corresponding brush core 314, of between 0.010-0.060 inches of the length $L_{B2}$ of the softer bristles 330.

Referring to FIGS. 2, 5, 6, 12A and 12B, in some implementations, the robot 100 includes a caster wheel assembly 126 located in the rearward portion 114 of the robot 100 and may be disposed about the fore-aft axis Y. The caster wheel assembly 126 includes a caster wheel 127*a* supported for vertical movement and a suspension spring 127*b* biasing the caster wheel 127*a* toward the floor surface 10. The suspension spring 127*b* has a spring constant sufficient to elevate a rearward portion 114 of the robot body 110 above the floor surface 10 to maintain engagement of the at least one cleaning element (e.g. roller brushes 310*a*, 310*b*) with the floor surface 10. The suspension spring 127*b* supports the rear end 116 of the robot body 110 at a height H above the floor surface 10 that causes engagement of at least 5% of a bristle length $L_B$ (e.g., the first and/or second bristle length $L_{B1}$, $L_{B2}$)of the roller brush bristles 318, 320, 330 with the floor surface 10. The center of gravity CG of the robot 100 may be located forward of the drive axis (0-35%) to help maintain the forward portion 112 of the body 110 downward, causing engagement of the roller brushes 310*a*, 310*b* with the floor 10. For example, that center of gravity placement allows the robot body 110 to pivot forwards about the drive wheels 124*a*, 124*b*.

In some examples, the caster wheel assembly 126 is a vertically spring-loaded swivel caster 126 biased to maintain contact with a floor surface 10. The vertically spring-loaded swivel caster wheel assembly 126 may be used to detect if the robot 100 is no longer in contact with a floor surface 10 (e.g., when the robot 100 backs up off a stair allowing the vertically spring-loaded swivel caster 126 to drop). Additionally, the caster wheel assembly 126 keeps the rear portion 114 of the robot body 110 off the floor surface 10 and prevents the robot 100 from scraping the floor surface 10 as it traverses the surface 10 or as the robot 100 climbs obstacles. Additionally, the vertically spring-loaded swivel caster assembly 126 allows for a tolerance in the location of the center of gravity CG to maintain contact between the roller brushes 310*a*, 310*b* and the floor 10.

In some implementations, the robot 100 includes at least one clearance regulator 128 disposed on the robot body 110 in a forward portion 112, forward of the drive wheels 124*a*,

124*b*. In some examples, the clearance regulator 128 is a roller or wheel rotatably supported by the robot body 110. The clearance regulator 128 may be right and left rollers 128*a*, 128*b* disposed forward of the drive wheels 124*a*, 124*b* and rearward of the roller brushes 310. The clearance regulators/rollers 128*a*, 128*b* may maintain a clearance height C (e.g., at least 5 mm) between a bottom surface 118 of the robot body 110 and the floor surface 10.

Figure 12C:
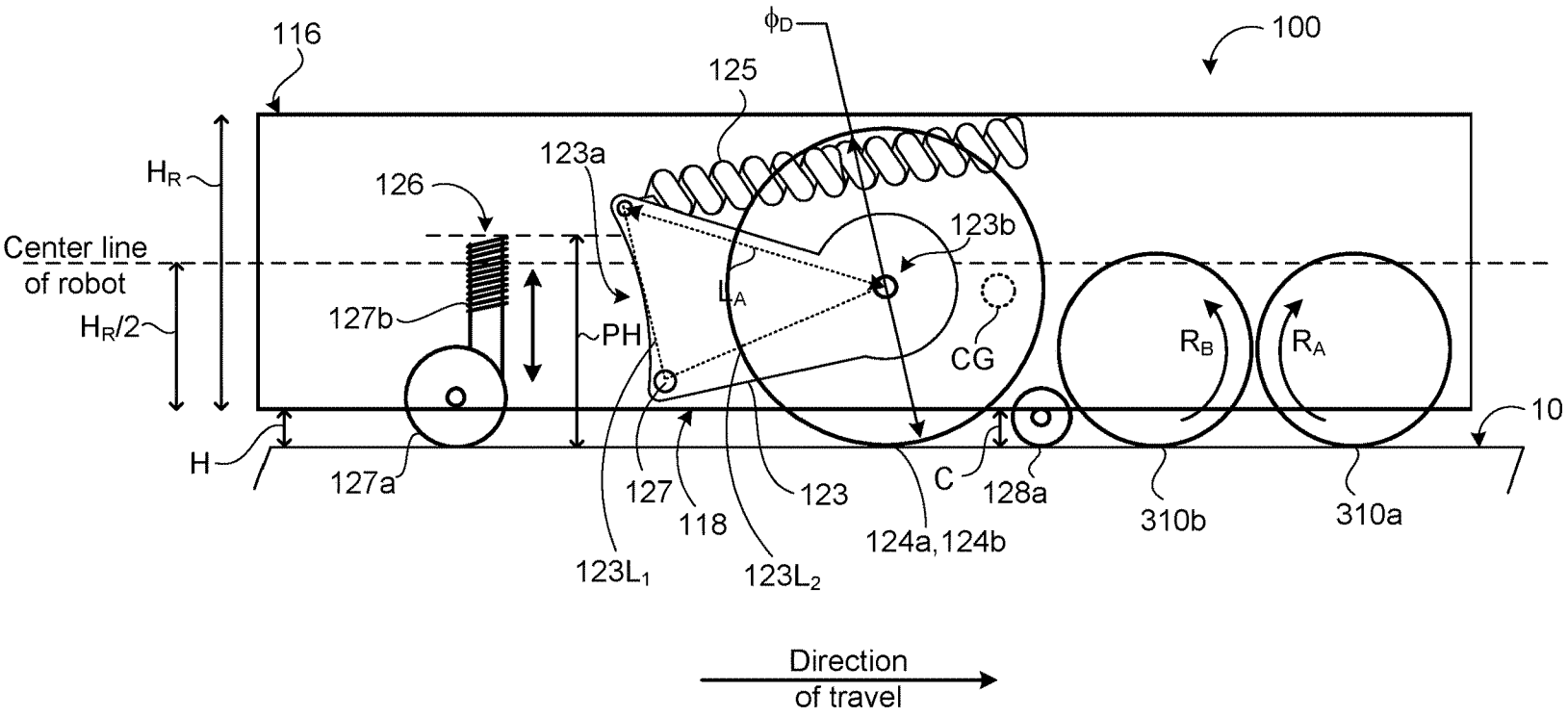
FIG. 12C is a side schematic view of an exemplary cleaning robot.
Figure 12D:
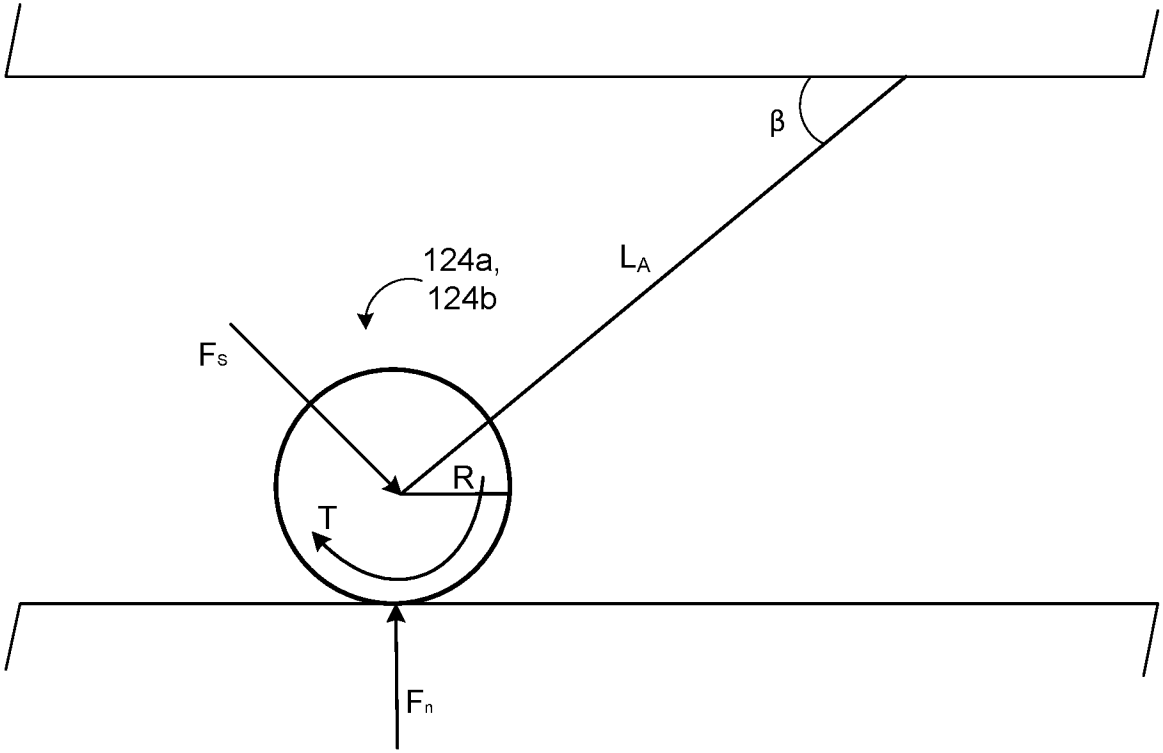
FIG. 12D is a schematic view of a wheel of a robot.

Referring to FIGS. 12B-12D, in some implementations, each drive wheel 124*a*, 124*b* is rotatably supported by a drive wheel suspension arm 123 having a first end 123*a* pivotally coupled to the robot body 110 and a second end 123*b* rotatably supporting the drive wheel 124*a*, 124*b*, and a drive wheel suspension spring 125 biasing the drive wheel 124*a*, 124*b* toward the floor surface 10. In some examples, the drive wheel suspension arm 123 is a bracket (FIG. 12C) having a pivot point 127*a*, a wheel pivot 127*b*, and spring anchor 127*c* spaced from the pivot point 127*a* and the wheel pivot 127*b*. A spring 125 biasing the spring anchor 127*b* causes the suspension arm 123 to rotate about the pivot point 127*a* (i.e., a fulcrum) to move the drive wheel 124*a*, 124*b* toward the floor surface 10. In some examples, the suspension arm 123 is an L-shaped bracket having first and second legs 123$L_1$, 123$L_2$. The pivot point 123*a*, 127*a* of the bracket 123 may be positioned in a lower 25% of a height $H_R$ of the robot 100 and is at least below half the height $H_R$ of the robot body 110, with respect to the floor surface 10. Additionally or alternatively, a hypotenuse of the L-shaped bracket 123 may have a length $L_A$ equal to between 70% and 150% of the height $H_R$ of the robot body 110. In some examples, the drive wheel suspension spring(s) 125 together provide a spring force $F_S$ equal to between 40% and 80% of an overall weight W of the robot 100 (e.g., $F_S$=0.5 W). Each drive wheel 124*a*, 124*b* may have a diameter $\phi_D$ equal to between 75% and 120% of the height $H_R$ of the robot body 110.

In some implementations, the wheels 124*a*, 124*b* perform differently depending on the direction of the wheel rotation (e.g., thicker floor surface or transition from different surfaces). Traction is the maximum frictional force produced between two surfaces (the robot wheels 124*a*, 124*b* and the floor surface 10) without slipping. A clockwise rotation and a counterclockwise rotation of the wheels 124*a*, 124*b* only equal if the traction T=0, or if $$\sin\beta = -\frac{R}{L}; \tag{1}$$

where β is the angle between the drive wheel suspension arm 123 with respect to a horizontal top portion of the robot body 110. R is the radius of the wheel 124*a*, 124*b*, and $L_A$ is the length of the wheel arm 123. The traction equals to zero only when the pivot point is on the floor surface 10. Therefore, to improve performance in the weak direction, the pivot point should be as close to zero and therefore as close to the floor surface 10. The lower the pivot point, the better the performance of the wheels 124*a*, 124*b*. The following two equations are considered for improving wheel performance:

$$CW: F_n = \frac{F_s}{\cos\beta} + \frac{T}{R}\left(\tan\beta + \frac{R}{L_A\cos\beta}\right) \tag{2}$$

-continued $$CCW: F_n = \frac{F_s}{\cos\beta} - \frac{T}{R}\left(\tan\beta + \frac{R}{L_A\cos\beta}\right) \tag{3}$$

where β is the angle between the drive wheel suspension arm 123 with respect to a horizontal top portion of the robot body 110. R is the radius of the wheel 124*a*, 124*b*, and $L_A$ is the length of the wheel arm 123. $F_s$ is the normal spring force and $F_n$ is the maximum allowable weight limit. Based on the above equations, in some examples, for a normal spring force Fs=2.5 lbf (constant), the wheel radius R=41 mm, the wheel arm has a length $L_A$=80 mm, mu=0.8 (coefficient of friction). Additionally, the arm may form an initial angle θ=−16.0°. In some examples, the maximum allowable Fn (Weight Limited)=2.5 lbf per wheel.

In some implementations, the robot 100 has forward body portion 112 having a flat forward face (e.g., a flat linear bumper 130), and a rearward body portion 114 defining a semi-circular shape. When the robot 100 approaches a corner and gets stuck in the corner, the robot 100 may need to drive backwards to escape the corner and/or wall. In some examples, a higher traction is needed when the robot 100 is moving backwards to improve the escape capabilities when the robot 100 is stuck.

A number of implementations have been described. Nevertheless, it will be understood that various modifications may be made without departing from the spirit and scope of the disclosure. Accordingly, other implementations are within the scope of the following claims.

What is claimed is:

1. A mobile surface cleaning robot comprising:

a robot body having a forward drive direction;

a drive system supporting the robot body above a floor surface for maneuvering the robot across the floor surface, the drive system comprising:

right and left drive wheels disposed on corresponding right and left portions of the robot body; and a caster wheel assembly disposed rearward of the drive wheels, the caster wheel assembly including a caster wheel supported for vertical movement and a suspension spring biasing the caster wheel toward the floor surface; and a cleaning system supported by the robot body forward of the drive wheels, the cleaning system comprising at least one cleaning element configured to engage the floor surface, wherein the suspension spring has a spring constant sufficient to elevate a rear end of the robot body above the floor surface to maintain engagement of the at least one cleaning element with the floor surface.

2. The robot of claim 1, wherein a center of gravity of the robot is located forward of the drive wheels, allowing the robot body to pivot forward about the drive wheels.

3. The robot of claim 2, wherein the center of gravity of the robot is located forward of the drive wheels by a distance of between 0% and 35% of a distance between a drive axis of the drive wheels and a forward end of the robot body, causing engagement of the at least one cleaning element with the floor surface.

4. The robot of claim 1, further comprising at least one clearance regulator supported by the robot body and disposed forward of the drive wheels and rearward of the at least one cleaning element, the at least one clearance regulator providing a minimum clearance height between a bottom surface of the robot body and the floor surface.

5. The robot of claim 4, wherein the minimum clearance height is at least 2 mm.

6. The robot of claim 4, wherein the at least one clearance regulator comprises a roller rotatably supported by the robot body.

7. The robot of claim 1, wherein the drive system further comprises:

right and left drive wheel suspension arms supporting the respective right and left drive wheels, each drive wheel suspension arm having a first end pivotally coupled to the robot body and a second end rotatably supporting the drive wheel; and right and left drive wheel suspension springs biasing the respective right and left drive wheels toward the floor surface.

8. The robot of claim 7, wherein each drive wheel suspension arm defines a pivot point, a wheel pivot, and a spring anchor spaced from the pivot point and the wheel pivot, each drive wheel suspension arm comprising a drive wheel suspension spring biasing the spring anchor, causing the drive wheel suspension arm to rotate about the pivot point to move the corresponding drive wheel toward the floor surface.

9. The robot of claim 8, wherein the drive wheel suspension spring provides a spring force equal to between 40% and 80% of an overall weight of the robot.

10. The robot of claim 8, wherein each drive wheel suspension arm defines an L-shape having first and second legs, the pivot point of the drive wheel suspension arm positioned at least below half a height of the robot body with respect to the floor surface.

11. The robot of claim 10, wherein a hypotenuse of the L-shaped drive wheel suspension arm has a length equal to between 70% and 150% of the height of the robot body.

12. The robot of claim 11, wherein a maximum allowable weight limit per drive wheel for clockwise and counter clockwise rotation is determined as:

$$CW: F_n = \frac{F_s}{\cos\beta} + \frac{T}{R}\left(\tan\beta + \frac{R}{L_A\cos\beta}\right)$$

$$CCW: F_n = \frac{F_s}{\cos\beta} - \frac{T}{R}\left(\tan\beta + \frac{R}{L_A\cos\beta}\right)$$

where $F_S$ is the spring force of the drive wheel suspension spring, β is the angle between the drive wheel suspension arm and a horizontal top portion of the robot body, T is the frictional traction force of the drive wheel, and R is the radius of the drive wheel.

13. The robot of claim 12, wherein each drive wheel has a diameter equal to between 75% and 120% of a height of the robot body.

14. The robot of claim 1, wherein the at least one cleaning element comprises a roller brush having bristles, the suspension spring elevating the rear end of the robot body above the floor surface to cause engagement of at least 5% of a bristle length of the roller brush bristles with the floor surface.

15. The robot of claim 14, wherein the roller brush comprises:

a brush core defining a longitudinal axis of rotation; and three or more dual rows of bristles disposed on and equidistantly spaced along a circumference the brush core, each dual row of bristles comprising:

a first bristle row comprising a first bristle composition and having a first height; and a second bristle row comprising a second bristle composition and having a second height, the second bristle row circumferentially spaced from the first bristle row by a gap less than or equal to 10% of the second height, the first height being less than or equal to 90% of the second height, wherein the first bristle composition is stiffer than the second bristle composition.

16. The robot of claim 15, wherein at least 5% of the second height of the second bristle row engages with the floor surface.

17. The robot of claim 15, wherein the first bristle row of each dual bristle row is forward of the second bristle row in a direction of rotation of the roller brush.

18. The robot of claim 15, wherein the roller brush further comprises elastomeric vanes arranged between and substantially parallel to the bristle rows, each vane extending from a first end attached to the brush core to a second end unattached from the brush core.

19. The robot of claim 1, wherein the at least one cleaning element comprises:

a first roller brush comprising:

a brush core defining a longitudinal axis of rotation; and three or more dual rows of bristles disposed on and equidistantly spaced along a circumference the brush core, each dual row of bristles comprising:

a first bristle row comprising a first bristle composition and having a first height; and a second bristle row comprising a second bristle composition and having a second height, the second bristle row circumferentially spaced from the first bristle row by a gap less than or equal to 10% of the second height, the first height being less than or equal to 90% of the second height, wherein the first bristle composition is stiffer than the second bristle composition; and a second roller brush arranged rotatably opposite the first roller brush, the second roller brush comprising:

a brush core defining a longitudinal axis of rotation; and three or more rows of bristles disposed on and circumferentially spaced about the brush core.

20. The robot of claim 1, wherein the robot body defines a square front profile or a round profile.

* * * * *